US011005216B2

(12) United States Patent
Hayasaka et al.

(10) Patent No.: US 11,005,216 B2
(45) Date of Patent: May 11, 2021

(54) CONNECTOR AND CONNECTOR STRUCTURE

(71) Applicant: Yazaki Corporation, Tokyo (JP)

(72) Inventors: Noboru Hayasaka, Shizuoka (JP); Jun Sugioka, Shizuoka (JP); Yasuhiro Tanaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/547,515

(22) Filed: Aug. 21, 2019

(65) Prior Publication Data

US 2020/0067232 A1 Feb. 27, 2020

(30) Foreign Application Priority Data

Aug. 24, 2018 (JP) ..... JP2018-157753

(51) Int. Cl.
*H01R 13/627* (2006.01)
*H01R 13/502* (2006.01)

(52) U.S. Cl.
CPC ..... *H01R 13/6273* (2013.01); *H01R 13/502* (2013.01)

(58) Field of Classification Search
CPC ..... H01R 13/502; H01R 13/627; H01R 13/6273; H01R 13/6275; H01R 13/639; H01R 13/641
See application file for complete search history.

(56) References Cited

U.S. PATENT DOCUMENTS 6,354,860 B1 * 3/2002 Miller ..... H01R 13/6272 439/352
2003/0045161 A1 * 3/2003 Endo ..... H01R 13/641 439/489
2010/0093204 A1 * 4/2010 Morello ..... H01R 13/6272 439/346
2010/0255709 A1 * 10/2010 Tyler ..... H01R 13/6275 439/367
2015/0222055 A1 * 8/2015 Plazio ..... H01R 13/639 439/347
2017/0025793 A1 * 1/2017 Horiuchi ..... H01R 13/641
(Continued)

FOREIGN PATENT DOCUMENTS

EP 0 977 322 A2 2/2000
EP 2 020 704 A2 2/2009
(Continued)

*Primary Examiner* — Oscar C Jimenez
(74) *Attorney, Agent, or Firm* — Kenealy Vaidya LLP

(57) ABSTRACT

A connector includes: an outer housing including an arm that protrudes from a first wall portion to a space portion surrounded by a housing main unit; an inner housing inside the housing main unit; and a detection member supported between the first wall portion and the inner housing slidably. The housing main unit has an opening portion in which a counterpart housing having a protrusion is inserted. The arm includes an arm main unit with flexibility extending toward the opening portion and a lock tab protruding from the arm main unit. When the counterpart housing is inserted, the arm main unit is elastically deformed to enable the lock tab to ride over and lock the protrusion. When the lock tab completes riding over, the lock tab allows the detection member to move toward the opening portion.

10 Claims, 18 Drawing Sheets

(56) References Cited

U.S. PATENT DOCUMENTS

| | | | | |
|---|---|---|---|---|
| 2017/0170602 | A1* | 6/2017 | Matsumoto | H01R 13/639 |
| 2017/0264050 | A1* | 9/2017 | Matsumoto | H01R 13/6271 |
| 2018/0226748 | A1 | 8/2018 | Hayasaka | |
| 2019/0312373 | A1* | 10/2019 | Nakamura | H01R 13/4365 |
| 2020/0106212 | A1* | 4/2020 | Endo | H01R 13/6272 |
| 2020/0136310 | A1* | 4/2020 | Nishiyama | H01R 13/6272 |

FOREIGN PATENT DOCUMENTS

| | | | |
|---|---|---|---|
| EP | 2 876 744 | A1 | 5/2015 |
| JP | 2000-58199 | A | 2/2000 |
| JP | 2017-111910 | A | 6/2017 |
| JP | 2018-129134 | A | 8/2018 |

* cited by examiner

CONNECTOR AND CONNECTOR STRUCTURE

CROSS-REFERENCE TO RELATED APPLICATION(S)

The present application claims priority to and incorporates by reference the entire contents of Japanese Patent Application No. 2018-157753 filed in Japan on Aug. 24, 2018.

BACKGROUND OF THE INVENTION

1. Field of the Invention

The present invention relates to a connector and a connector structure.

2. Description of the Related Art

A hitherto known technique detects whether connectors completely fit each other. Japanese Patent Application Laid-open No. 2017-111910 discloses a technique of a connector that includes a first housing, a second housing, and a fitting detection member incorporated in the second housing.

A need exists for a technique of a connector that includes a mechanism for detecting whether connectors completely fit each other, while achieving reduction in size of the connector.

SUMMARY OF THE INVENTION

An object of the present invention is to provide a connector and a connector structure that each include a mechanism for detecting whether connectors completely fit each other, while achieving reduction in size of the connector.

In order to achieve the above mentioned object, a connector according to one aspect of the present invention includes an outer housing including a housing main unit with a tubular shape and an arm that protrudes from a first wall portion of the housing main unit to a space portion surrounded by the housing main unit; an inner housing disposed interior to the housing main unit, the inner housing holding a first terminal; and a detection member supported between the first wall portion and the inner housing slidably along an axial direction of the housing main unit, wherein the housing main unit has an opening portion in which a counterpart housing is inserted, the counterpart housing including a protrusion and holding a second terminal, the arm includes an arm main unit with flexibility that extends toward the opening portion and a lock tab that protrudes from the arm main unit, when the counterpart housing is inserted in the housing main unit through the opening portion, the arm main unit of the arm is elastically deformed to enable the lock tab to ride over and lock the protrusion, and when the counterpart housing is inserted into the housing main unit, the lock tab locks the detection member to restrict motion of the detection member toward the opening portion while the lock tab has not yet ridden over the protrusion, and the lock tab allows the detection member to move toward the opening portion after the lock tab completes riding over the protrusion.

According to another aspect of the present invention, in the connector, it is preferable that the arm main unit includes a first arm portion that protrudes from the first wall portion and extends toward the opening portion, a second arm portion that extends from a distal end of the first arm portion toward a side opposite to the opening portion, and an operating portion disposed at a distal end of the second arm portion and exposed to the outside of the housing main unit.

In order to achieve the above mentioned object, a connector structure according to still another aspect of the present invention includes a first connector having a first terminal; and a second connector configured to engage with the first connector and having a second terminal to be connected with the first terminal, wherein the first connector includes: an outer housing including a housing main unit with a tubular shape and an arm that protrudes from a first wall portion of the housing main unit to a space portion surrounded by the housing main unit; an inner housing disposed interior to the housing main unit, the inner housing holding the first terminal; and a detection member supported between the first wall portion and the inner housing slidably along an axial direction of the housing main unit, the second connector includes a housing that includes a protrusion and holds the second terminal, the housing main unit has an opening portion in which the housing of the second connector is inserted, the arm includes an arm main unit with flexibility that extends toward the opening portion and a lock tab that protrudes from the arm main unit, when the housing of the second connector is inserted into the housing main unit through the opening portion, the arm main unit of the arm is elastically deformed to enable the lock tab to ride over and lock the protrusion, and when the housing of the second connector is inserted into the housing main unit, the lock tab locks the detection member to restrict motion of the detection member toward the opening portion while the lock tab has not yet ridden over the protrusion, and the lock tab allows the detection member to move toward the opening portion after the lock tab completes riding over the protrusion.

According to still another aspect of the present invention, in the connector structure, it is preferable that when the lock tab completes riding over the protrusion, the protrusion guides a distal end portion of the detection member onto a gap between the lock tab and the first wall portion.

According to still another aspect of the present invention, in the connector structure, it is preferable that the housing of the second connector includes a pair of ribs extending in the axial direction and disposed such that the protrusion is interposed therebetween, and the pair of ribs has a protruding height equal to or greater than a protruding height of the protrusion.

According to still another aspect of the present invention, in the connector structure, it is preferable that the detection member includes a tab portion to be inserted in a gap between the arm and the first wall portion, and the tab portion is inserted in the gap between the arm and the first wall portion by the movement of the detection member that has been locked by the lock tab toward the opening portion, thereby restricting elastic deformation of the arm toward the first wall portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following details, with reference to the accompanying drawings, an embodiment of the present invention. The embodiment is illustrative only and should not be considered limiting. The elements described hereunder include those that can be easily conceived by those skilled in the art or those that are substantially identical to each other.

Embodiment

Figure 1:
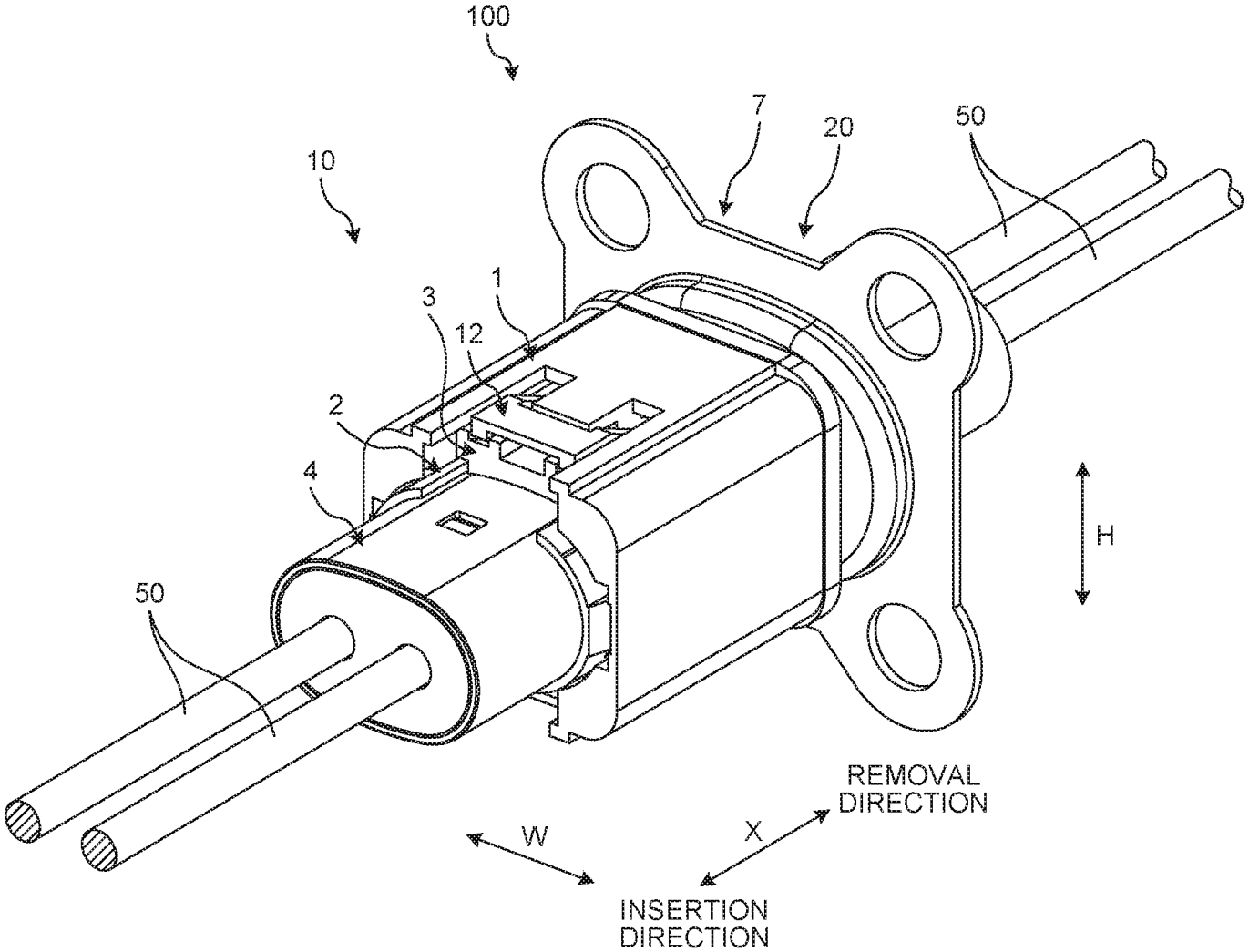
FIG. 1 is a perspective view of a connector structure according to an embodiment.
Figure 2:
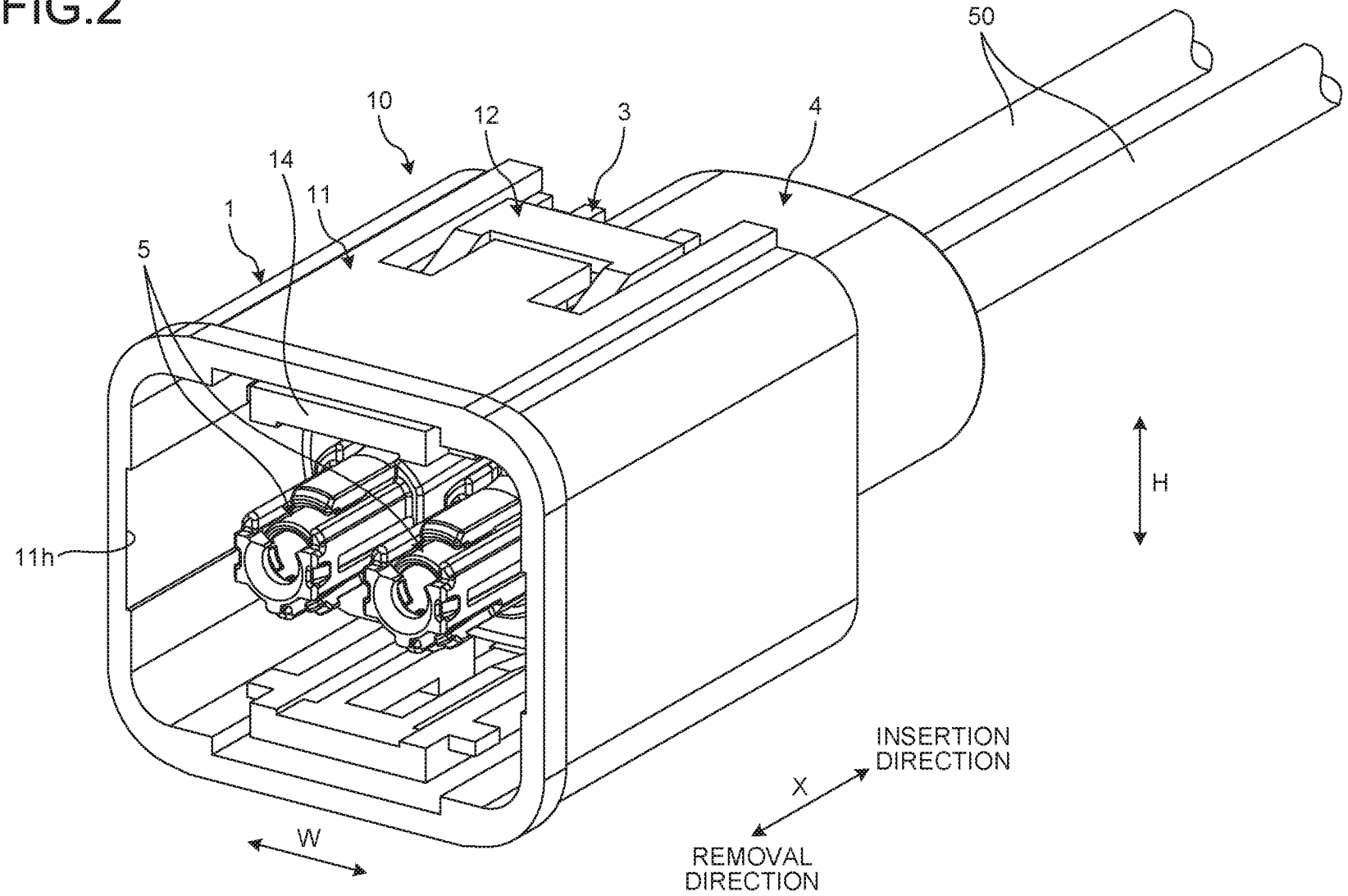
FIG. 2 is a perspective view of a first connector in the embodiment.
Figure 3:
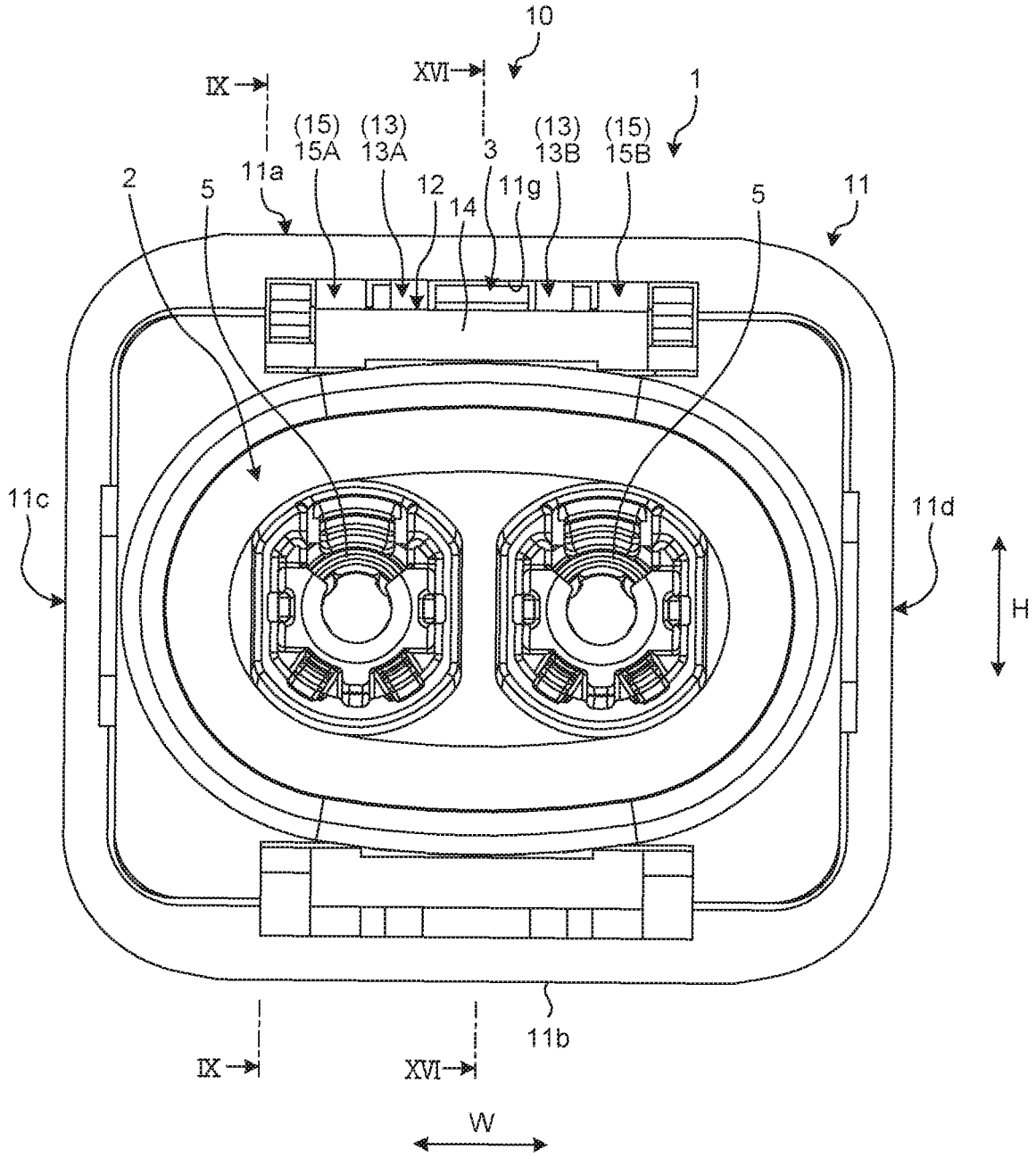
FIG. 3 is a front elevation view of the first connector in the embodiment.
Figure 4:
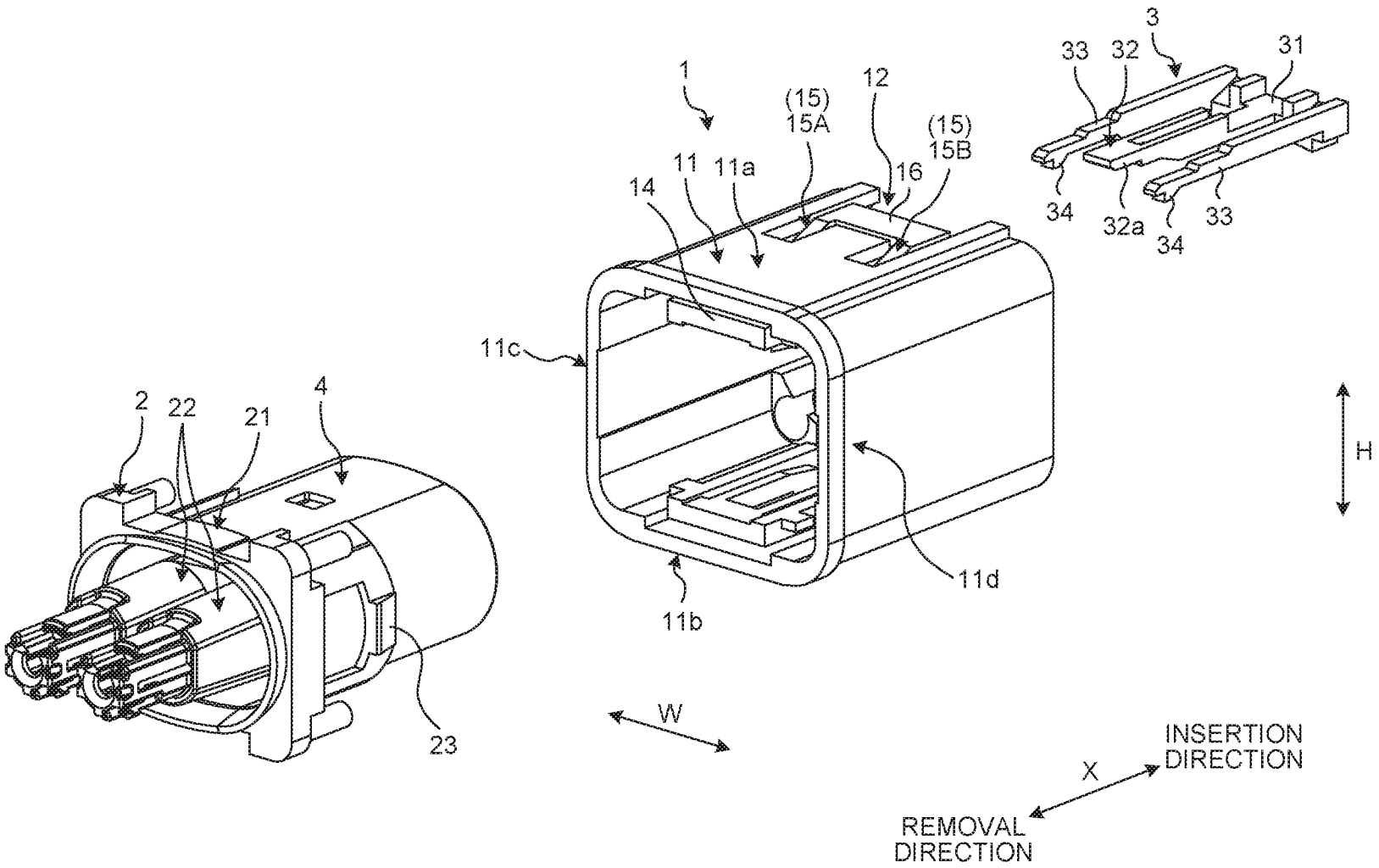
FIG. 4 is an exploded perspective view of the first connector in the embodiment.
Figure 5:
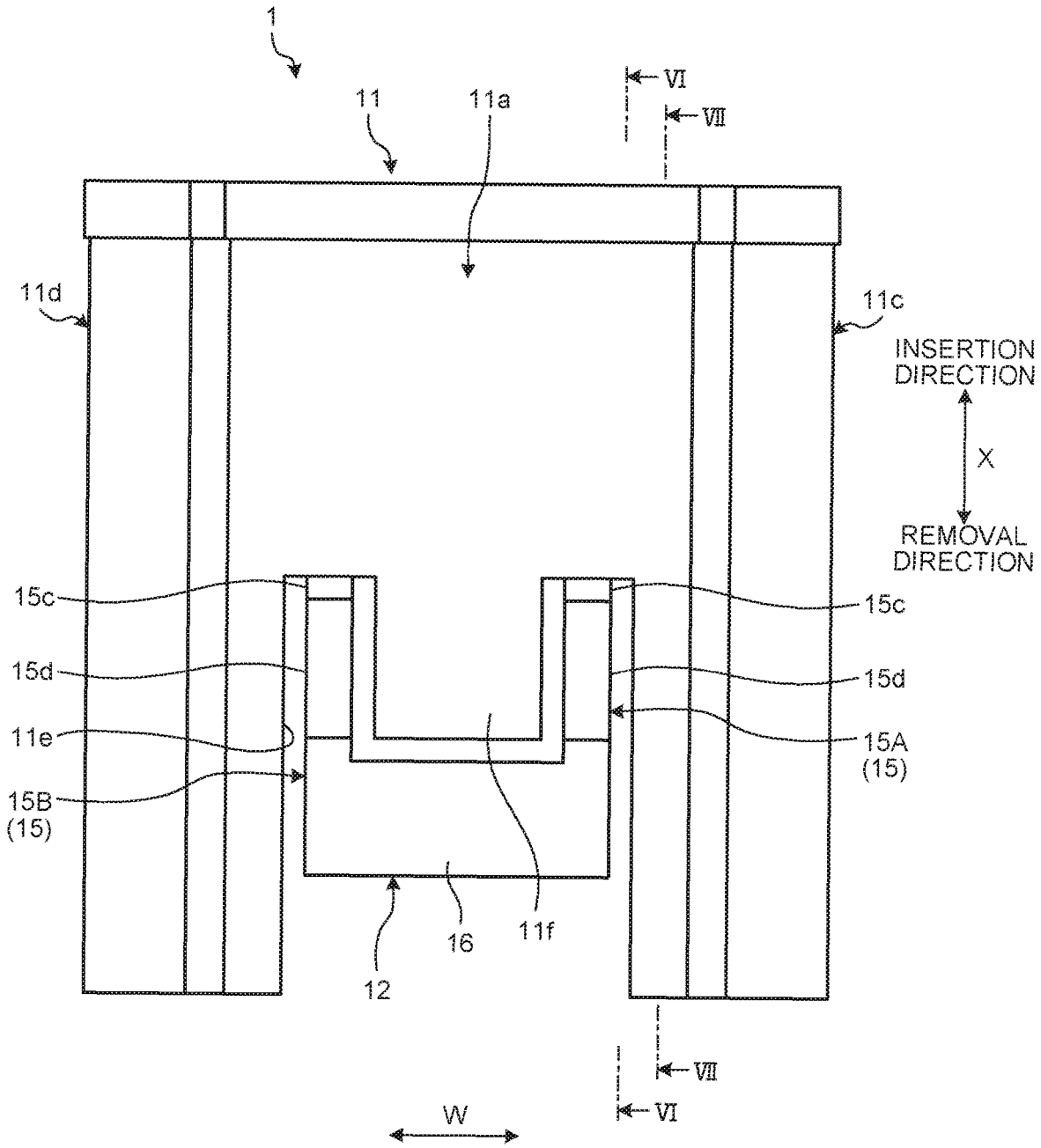
FIG. 5 is a plan view of an outer housing in the embodiment.
Figure 6:
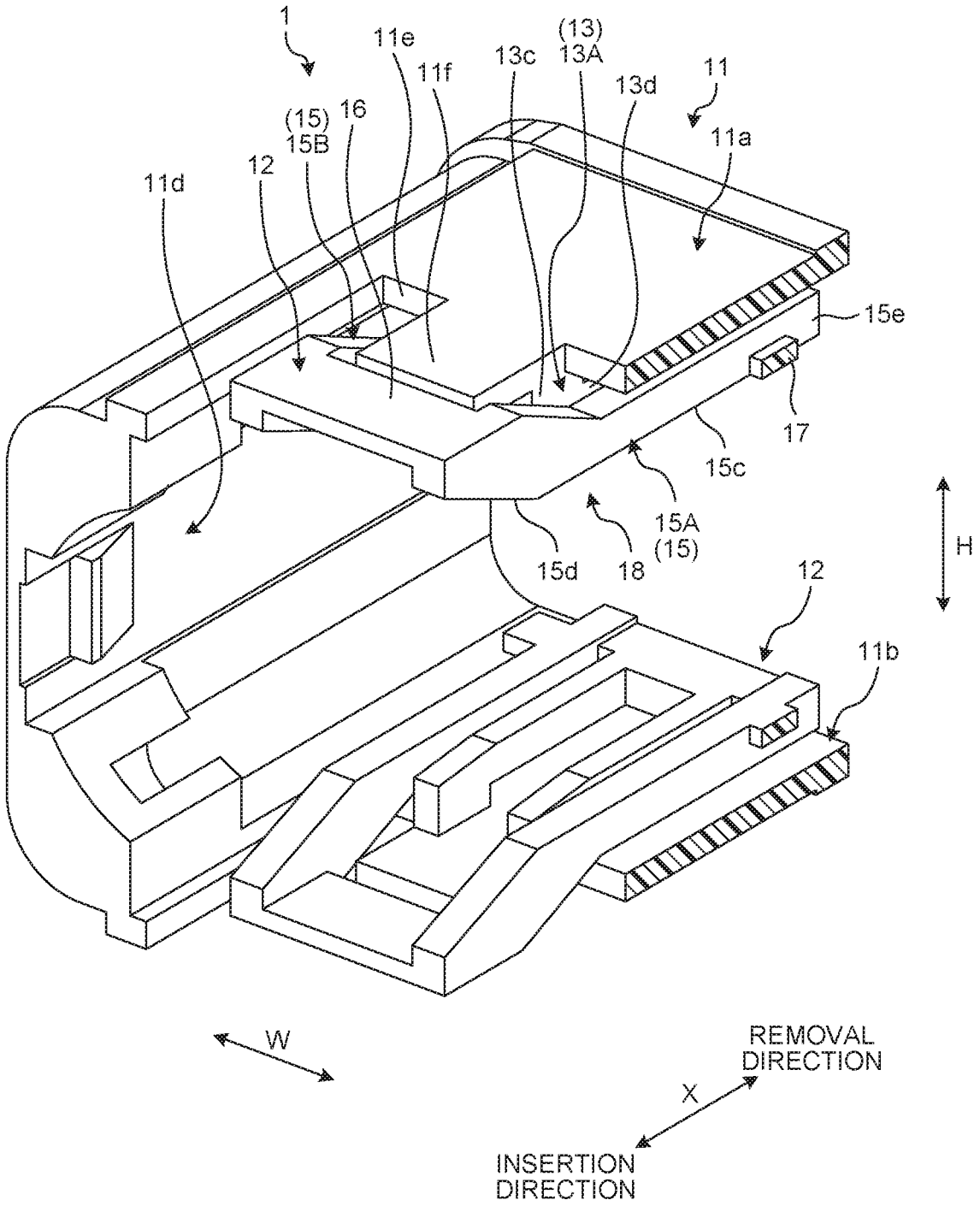
FIG. 6 is a cross-sectional, perspective view of the outer housing in the embodiment.
Figure 7:
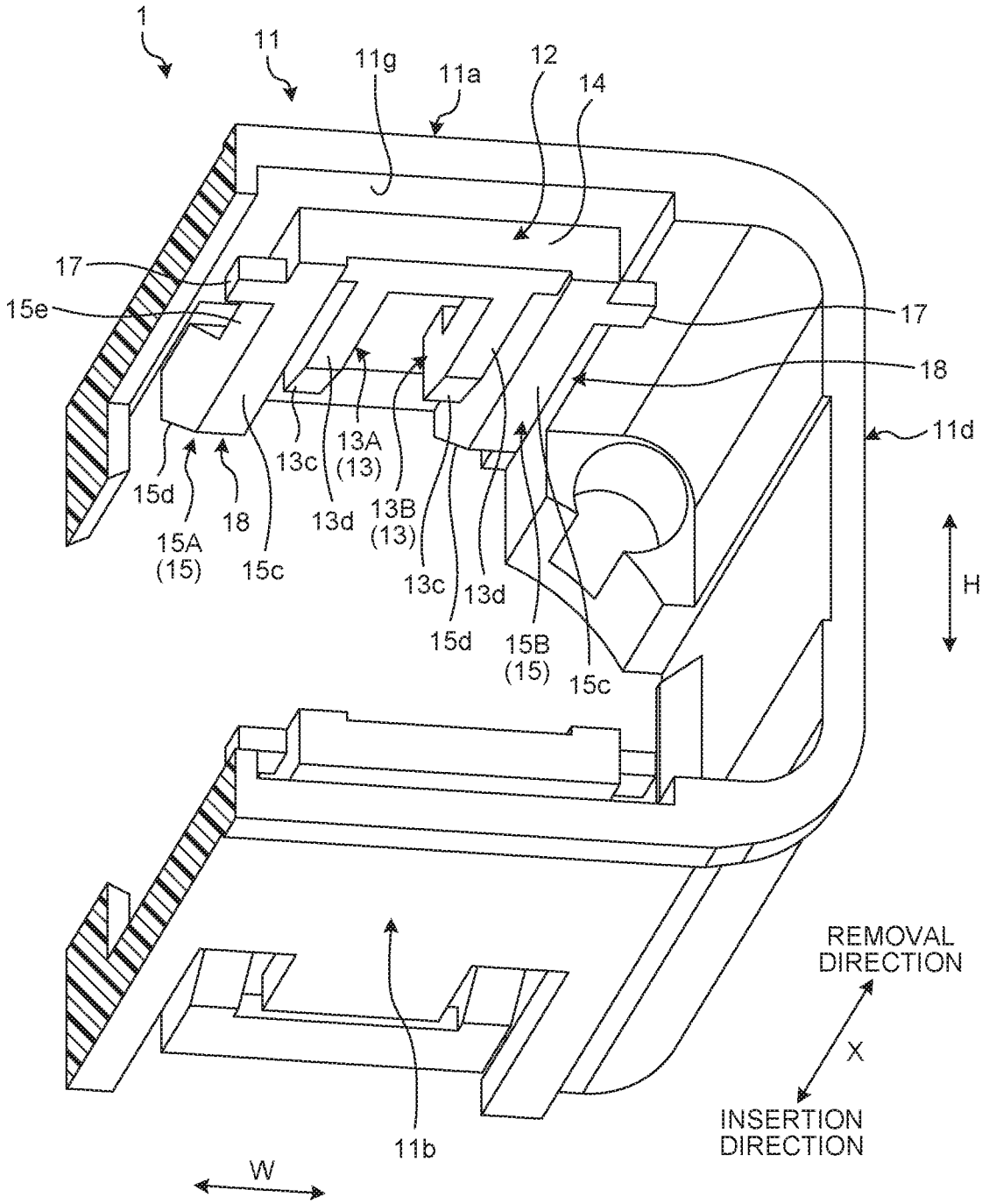
FIG. 7 is a perspective view of the outer housing in the embodiment.
Figure 8:
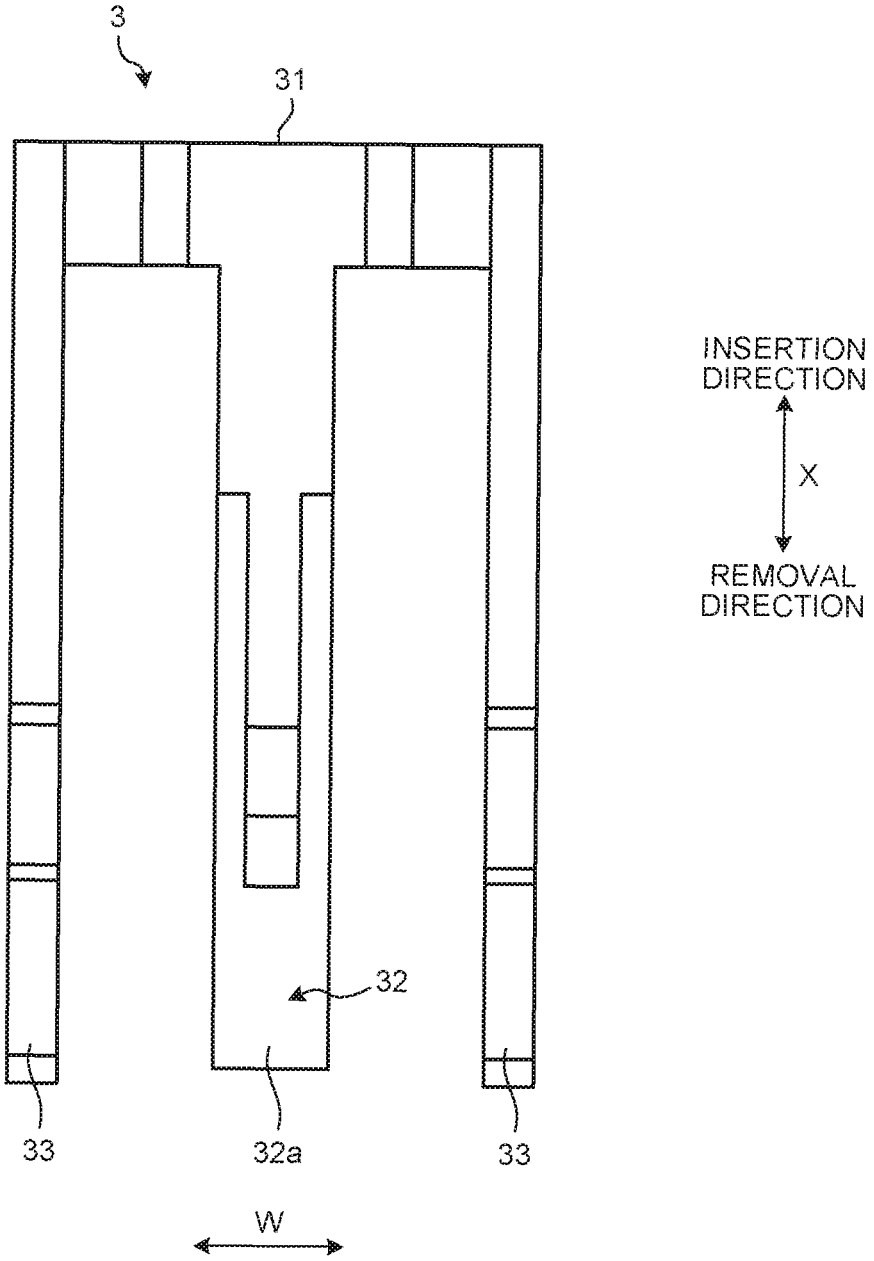
FIG. 8 is a plan view of a detection member in the embodiment.
Figure 9:
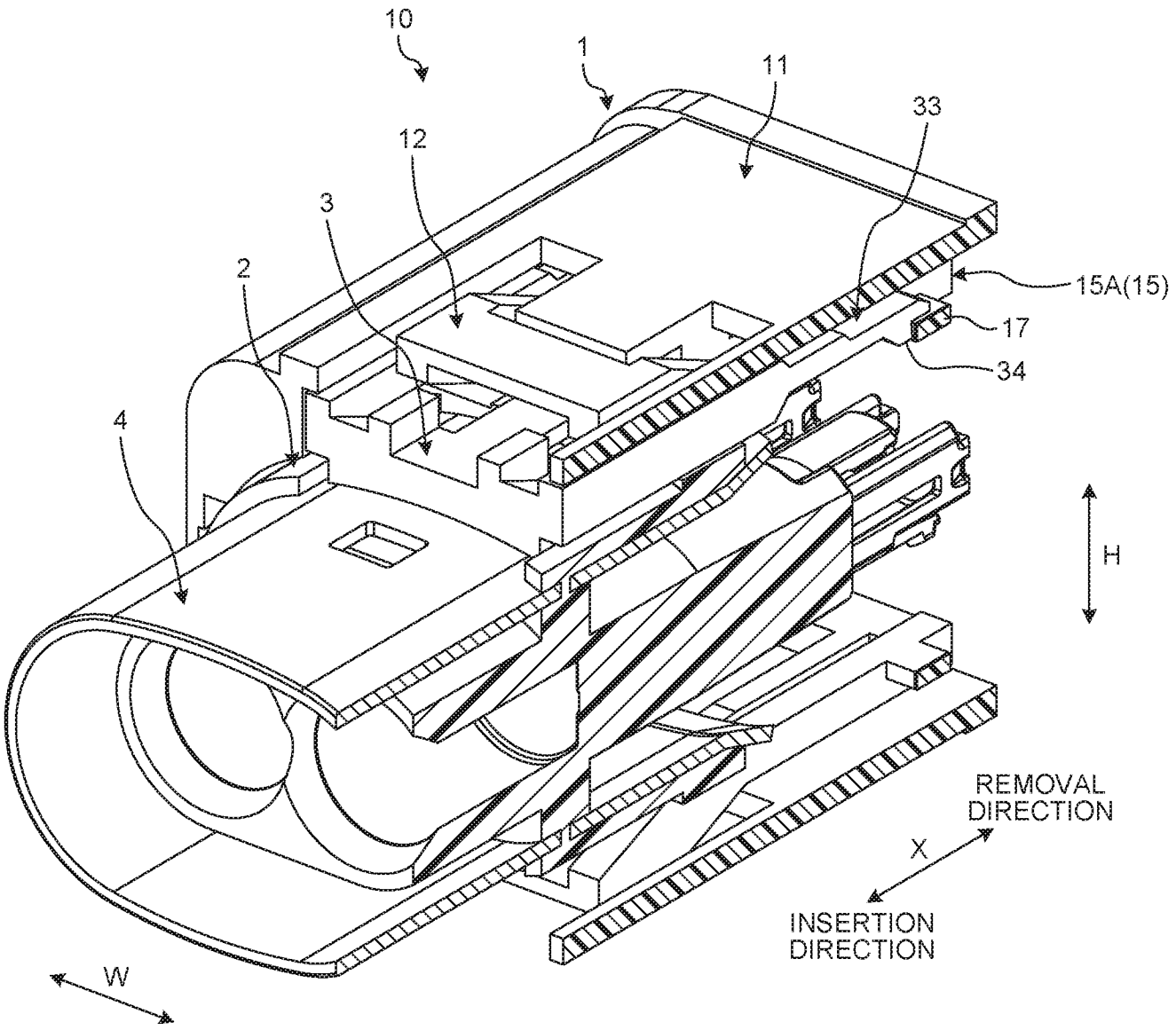
FIG. 9 is a cross-sectional, perspective view of an inner housing and a shell in the embodiment.
Figure 10:
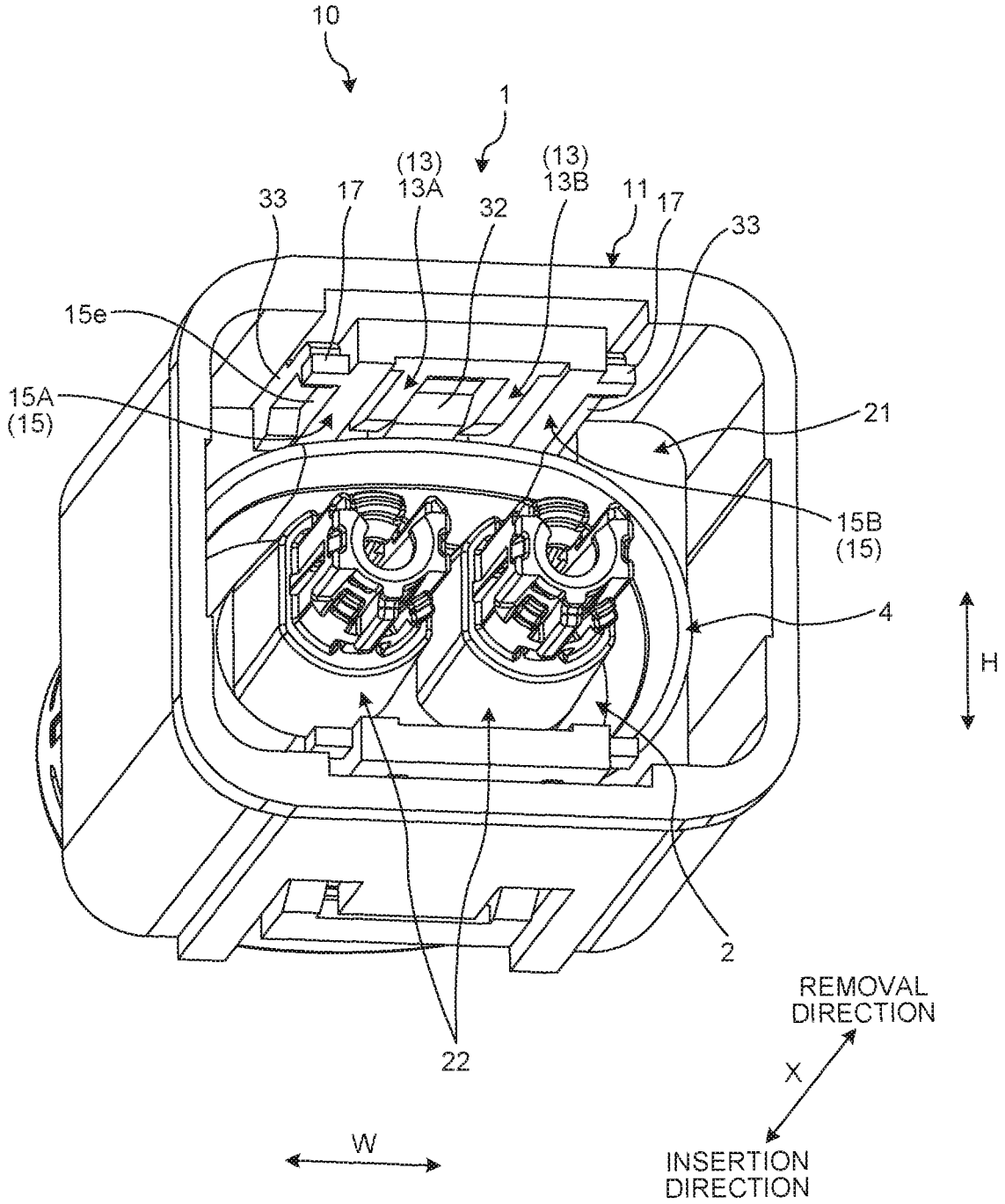
FIG. 10 is another perspective view of the first connector in the embodiment.
Figure 11:
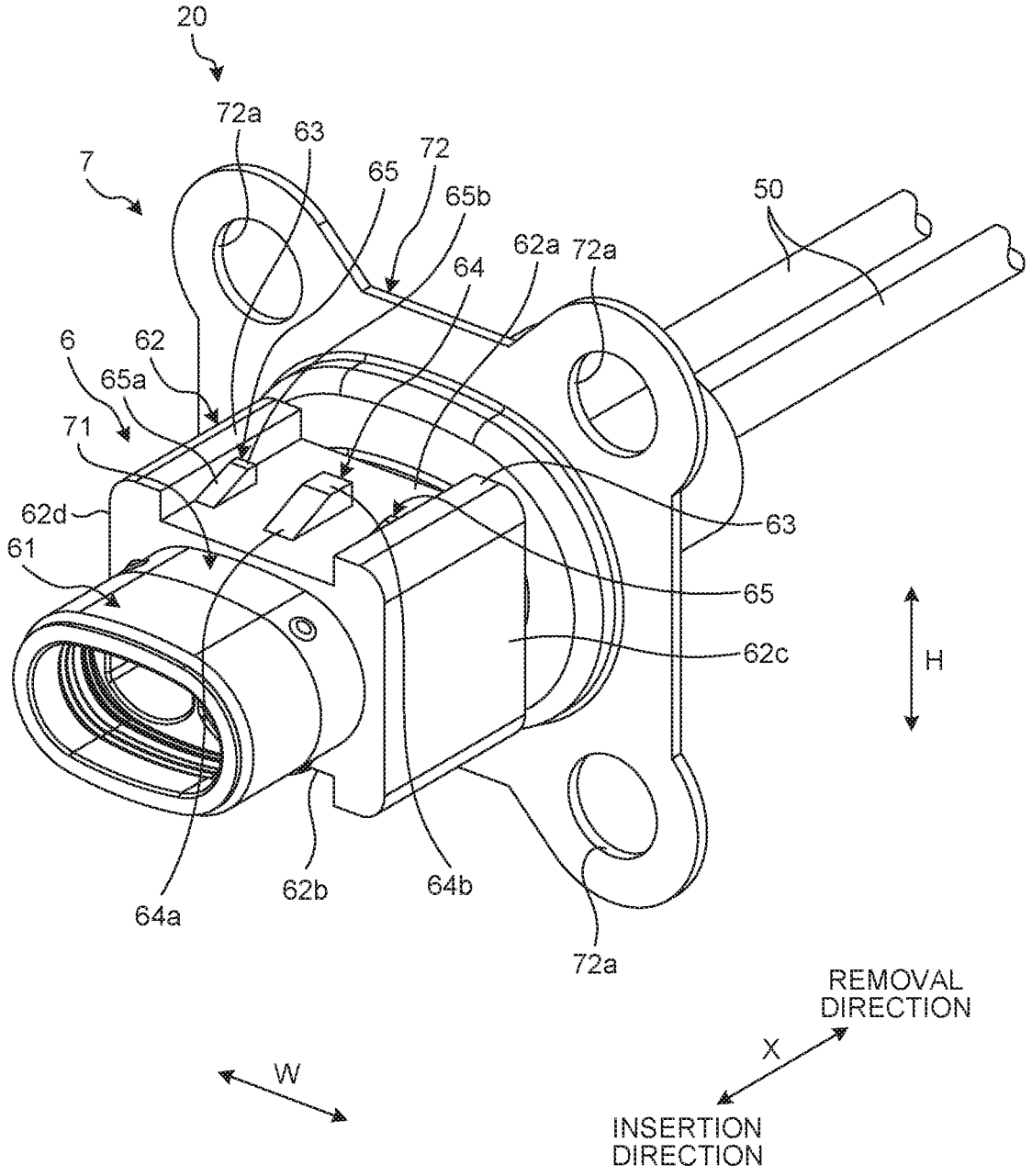
FIG. 11 is a perspective view of a second connector in the embodiment.
Figure 12:
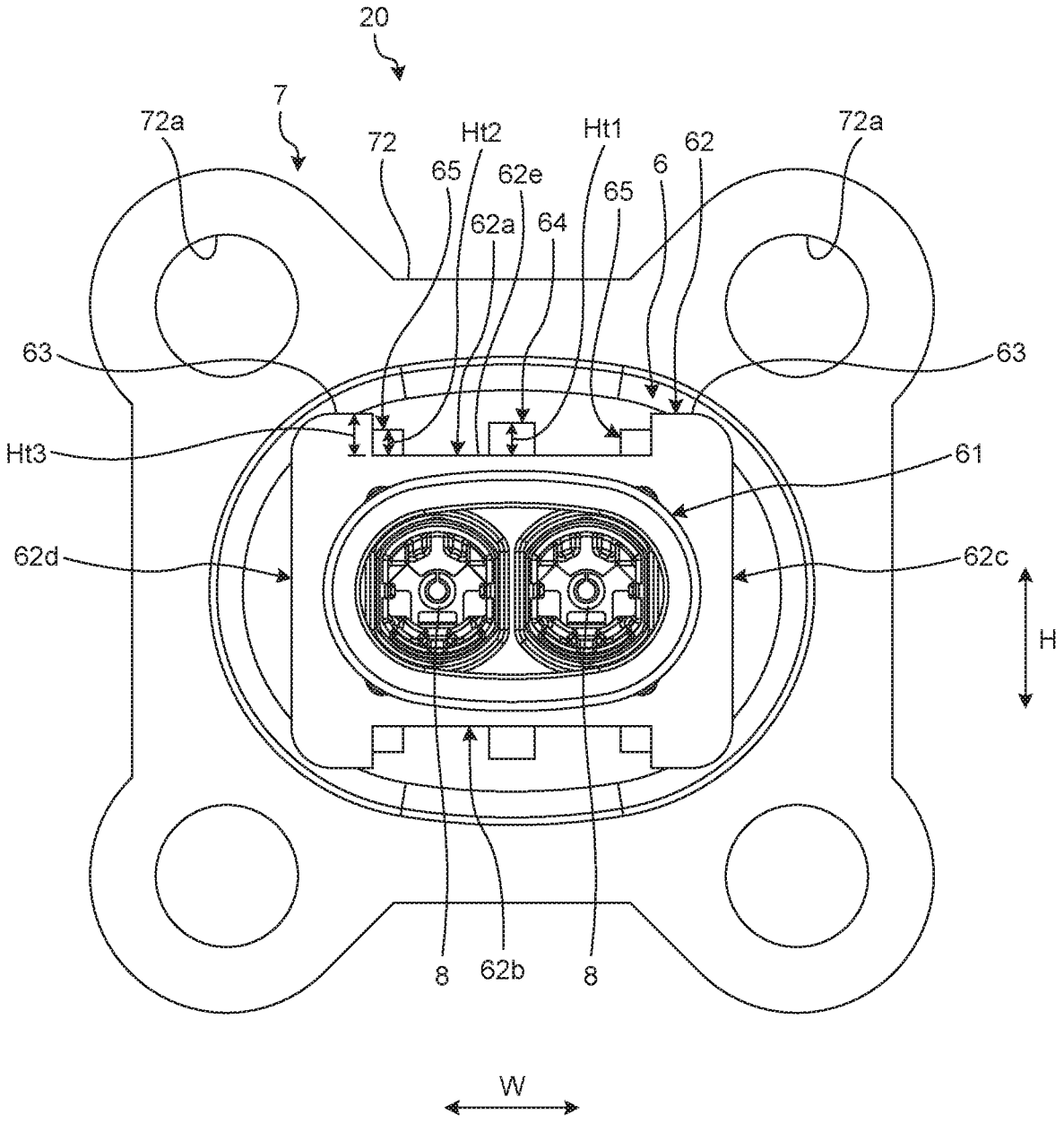
FIG. 12 is a front elevation view of the second connector in the embodiment.
Figure 13:
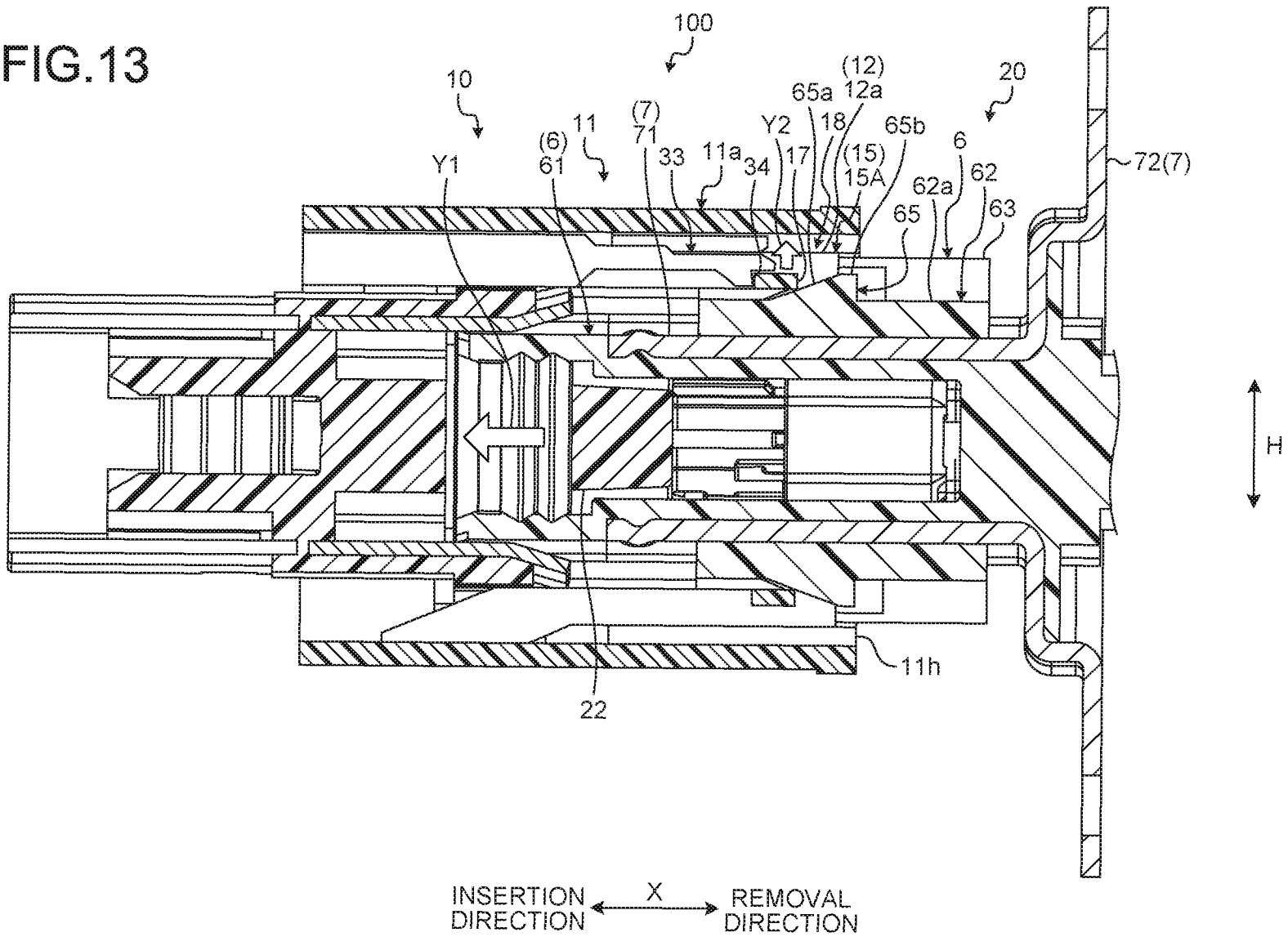
FIG. 13 is a cross-sectional view of the first connector and the second connector at a start of fitting.
Figure 14:
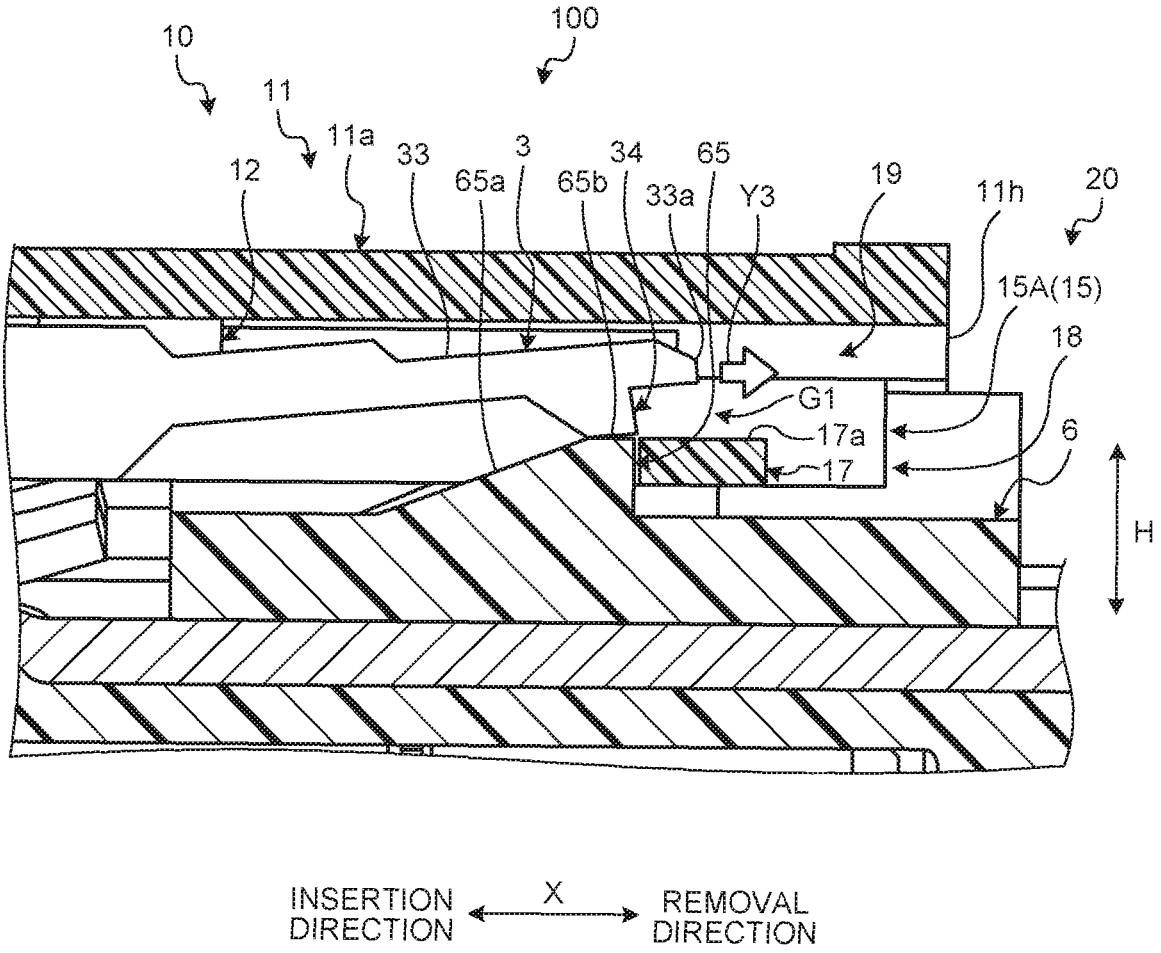
FIG. 14 is a cross-sectional view of the first connector and the second connector in a complete fitting state.
Figure 15:
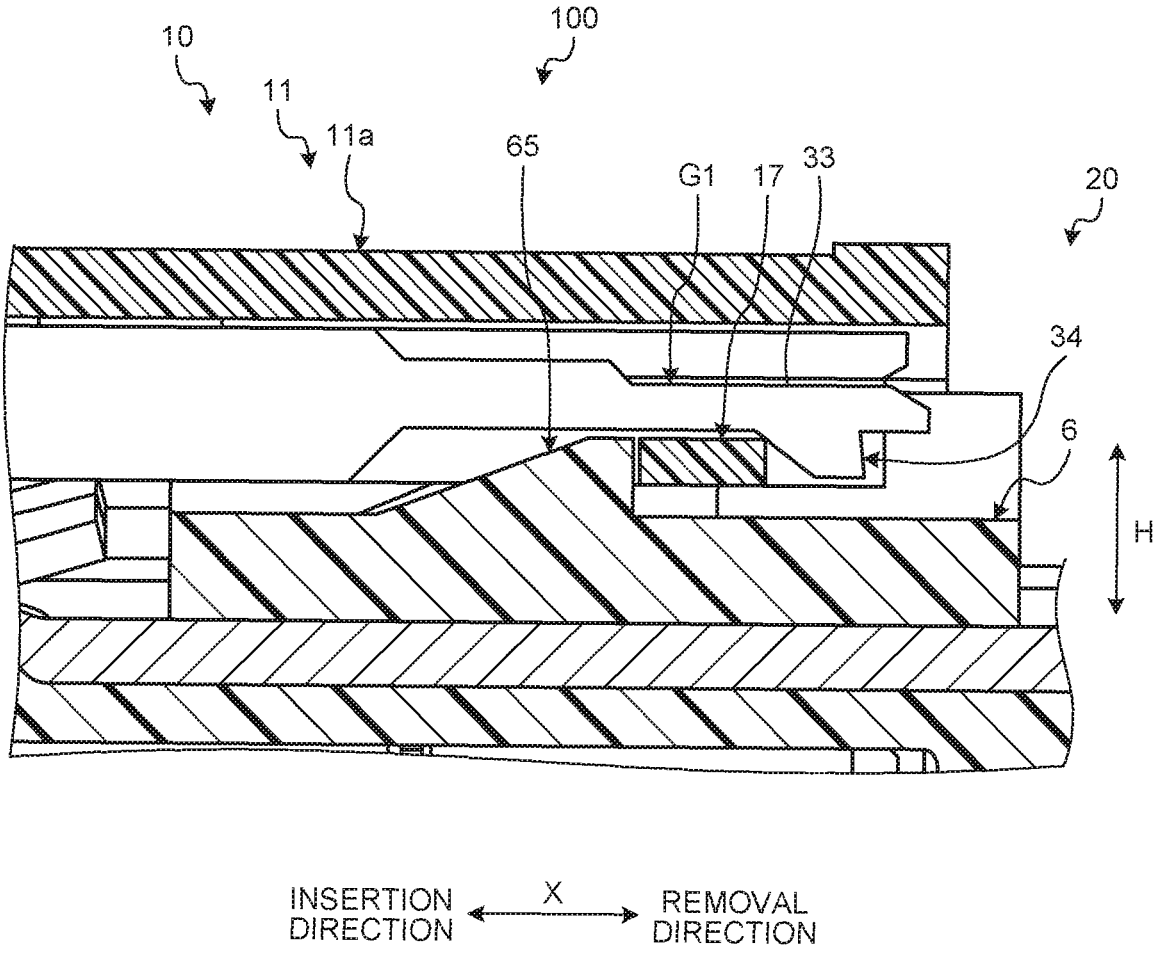
FIG. 15 is a cross-sectional view of the detection member in a locking state in the embodiment.
Figure 16:
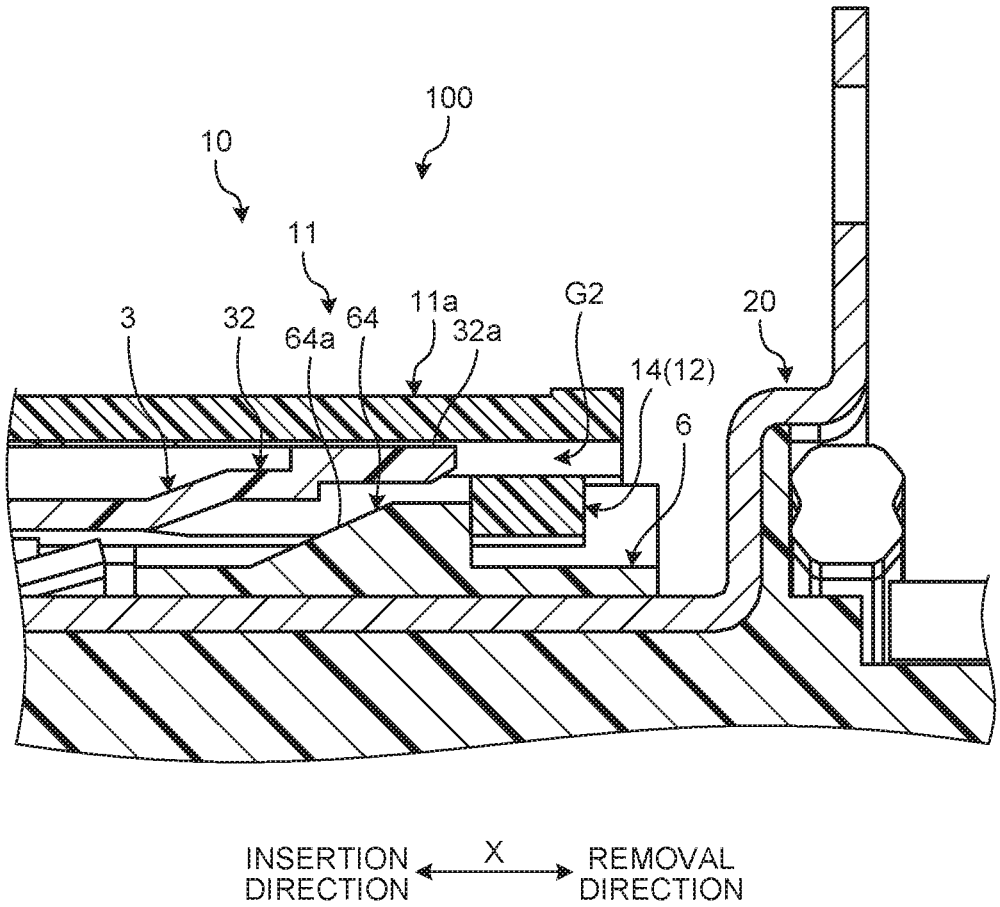
FIG. 16 is a cross-sectional view of the detection member at a temporary locked position in the embodiment.
Figure 17:
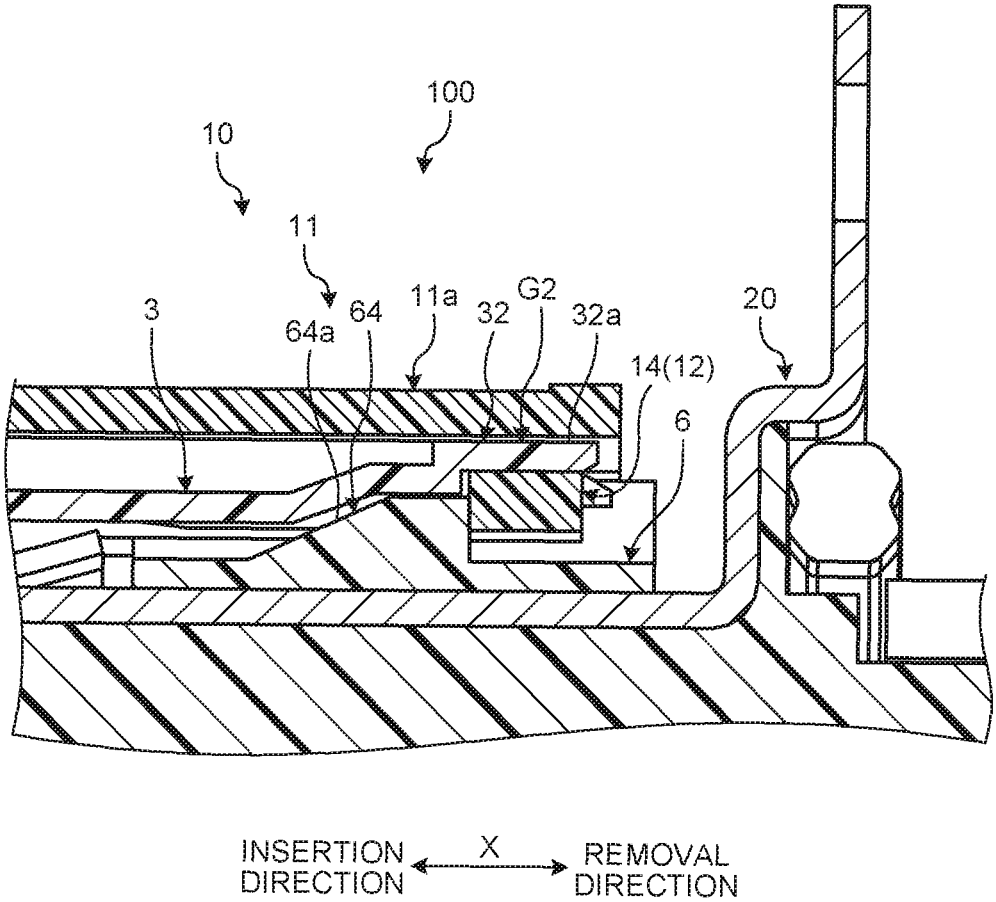
FIG. 17 is another cross-sectional view of the detection member in the locking state in the embodiment.
Figure 18:
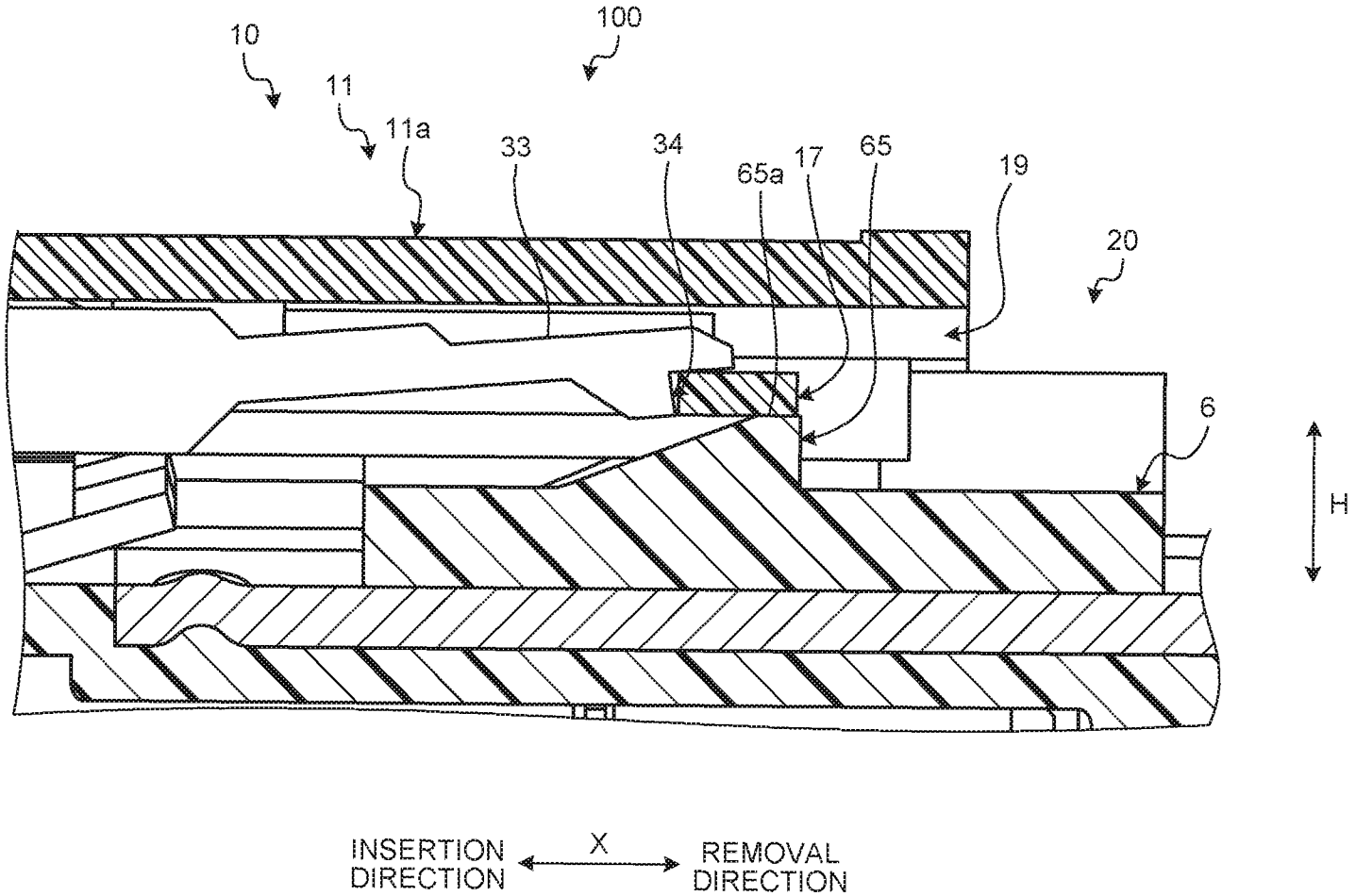
FIG. 18 is a cross-sectional view of the first connector and the second connector in a half-fitting state.

The following describes the embodiment with reference to FIGS. 1 to 18. The embodiment relates to a connector and a connector structure. FIG. 1 is a perspective view of the connector structure in embodiment. FIG. 2 is a perspective view of a first connector in the embodiment. FIG. 3 is a front elevation view of the first connector in the embodiment. FIG. 4 is an exploded perspective view of the first connector in the embodiment. FIG. 5 is a plan view of an outer housing in the embodiment. FIG. 6 is a cross-sectional, perspective view of the outer housing in the embodiment. FIG. 7 is a perspective view of the outer housing in the embodiment. FIG. 8 is a plan view of a detection member in the embodiment. FIG. 9 is a cross-sectional, perspective view of an inner housing and a shell in the embodiment. FIG. 10 is another perspective view of the first connector in the embodiment. FIG. 11 is a perspective view of a second connector in the embodiment. FIG. 12 is a front elevation view of the second connector in the embodiment. FIG. 13 is a cross-sectional view of the first connector and the second connector at a start of fitting. FIG. 14 is a cross-sectional view of the first connector and the second connector in a complete fitting state. FIG. 15 is a cross-sectional view of the detection member in a locking state in the embodiment. FIG. 16 is a cross-sectional view of the detection member at a temporary locked position in the embodiment. FIG. 17 is another cross-sectional view of the detection member in the locking state in the embodiment. FIG. 18 is a cross-sectional view of the first connector and the second connector in a half-fitting state.

FIG. 6 is a cross-sectional view taken along VI-VI in FIG. 5. FIG. 7 is a cross-sectional view taken along VII-VII in FIG. 5. FIG. 9 is a cross-sectional view taken along IX-IX in FIG. 3. FIGS. 13 to 15 are each a cross-sectional view taken along the line cut as in FIG. 9. FIGS. 16 and 17 are each a cross-sectional view taken along XVI-XVI in FIG. 3.

As illustrated in FIG. 1, this connector structure 100 in the embodiment includes a first connector 10 and a second connector 20. The first connector 10 and the second connector 20 make a pair of fitting connectors and fit each other.

In the description that follows, an axial line direction of the first connector 10 is referred to simply as an "axial direction X". An insertion direction of the first connector 10 in the axial direction X with respect to the second connector 20 is referred to simply as an "insertion direction". A direction opposite to the insertion direction in the axial direction X is referred to as a "removal direction".

The first connector 10 in the embodiment is a female connector including female terminals 5. The first connector 10 includes an outer housing 1, an inner housing 2, a detection member 3, a shell 4, and the female terminals 5. Electric wires 50 are connected with the respective female terminals 5.

The outer housing 1 is formed of, for example, an insulating synthetic resin. As illustrated in FIGS. 2 to 4, the outer housing 1 includes a housing main unit 11 with a tubular shape and a lock arm 12. The housing main unit 11 has a rectangular tubular shape having a substantially rectangular cross section. The housing main unit 11 includes a first wall portion 11*a*, a second wall portion 11*b*, a third wall portion 11*c*, and a fourth wall portion 11*d*.

The first wall portion 11*a* and the second wall portion 11*b* face each other. A direction in which the first wall portion 11*a* and the second wall portion lib face each other is referred to as a "height direction H". The height direction H is orthogonal to the axial direction X. The third wall portion 11*c* and the fourth wall portion 11*d* face each other. A direction in which the third wall portion 11*c* and the fourth wall portion 11*d* face each other is referred to as a "width direction W". The width direction W is orthogonal to the axial direction X and the height direction H.

A cutout portion 11*e* is formed in an end portion in the insertion direction of the first wall portion 11*a*. The first wall portion 11*a* includes a guard portion 11*f*. The guard portion 11*f* protrudes from the cutout portion lie. The guard portion 11*f* covers the detection member 3 to protect the detection member 3. The guard portion 11*f* in the embodiment has a rectangular shape. The housing main unit 11 has an opening portion 11*h*. The opening portion 11*h* is an insertion port into which a housing 6 of the second connector 20 is inserted.

The lock arm 12 is formed integrally with the housing main unit 11. The lock arm 12 includes a first arm portion 13, a beam portion 14, a second arm portion 15, and an operating portion 16. The first arm portion 13 and the second arm portion 15 constitute an arm main unit 18. The first arm portion 13 protrudes from an inner side surface 11*g* of the first wall portion 11*a* to a space portion 19. The space portion 19 is surrounded by the housing main unit 11. To state the foregoing differently, the space portion 19 is a space disposed interior to the housing main unit 11.

The lock arm 12 in the embodiment includes two first arm portions 13A and 13B. The two first arm portions 13A and 13B are disposed in juxtaposition with, and to be spaced away from, each other along the width direction W. In this specification, the two first arm portions 13A and 13B, when one is not differentiated from the other, are referred to collectively as the first arm portion 13. As illustrated in FIGS. 6 and 7, the first arm portion 13 has a proximal end portion 13*c* protruding from the inner side surface 11*g* along the height direction H. The first arm portion 13 has a main portion 13*d* extending from the proximal end portion 13*c* toward the removal direction.

A predetermined gap is provided between the main portion 13*d* and the first wall portion 11*a*. The gap permits elastic deformation of the lock arm 12. When, for example, the second connector 20 fits the first connector 10, the lock arm 12 is elastically deformed such that a distal end of the first arm portion 13 approaches the first wall portion 11*a* (see FIG. 13). The outer housing 1 is formed to have a movable space that permits such elastic deformation. Specifically, a space that enables the lock arm 12 to be elastically deformed is provided between the housing main unit 11 and the second connector 20, and between the housing main unit 11 and the inner housing 2.

The beam portion 14 is a bar-shaped or plate-shaped element. The beam portion 14 is joined with the distal end of the first arm portion 13. The beam portion 14 joins the distal end of the first arm portion 13A to the distal end of the first arm portion 13B to extend along the width direction W. The beam portion 14 has end portions protruding to the outside in the width direction W relative to the first arm portion 13.

The second arm portion 15 extends from the end portions of the beam portion 14 in the insertion direction. The lock arm 12 in the embodiment includes two second arm portions 15A and 15B. The second arm portion 15A is joined with a first end of the beam portion 14 and the second arm portion 15B is joined with a second end of the beam portion 14. The two second arm portions 15A and 15B face each other across the two first arm portions 13A and 13B interposed therebetween. In this specification, the two second arm portions 15A and 15B, when one is not differentiated from the other, are referred to collectively as the second arm portion 15.

The second arm portion 15 includes a main portion 15*c* and a distal end portion 15*d*. The main portion 15*c* is on a proximal end side of the second arm portion 15 and is joined with the beam portion 14. The main portion 15*c* extends in a direction that extends substantially in parallel with the axial direction X. The distal end portion 15*d* extends in a direction inclined with respect to the axial direction X. More specifically, the distal end portion 15*d* is inclined so as to be spaced farther away from the second wall portion lib at distances closer to the distal end.

The operating portion 16 joins the distal end portion 15*d* of the second arm portion 15A with the distal end portion 15*d* of the second arm portion 15B to extend along the width direction W. A force applied to the operating portion 16 along the height direction H elastically deforms the lock arm 12. Application of a force to the operating portion 16 toward the second wall portion 11*b*, for example, causes the lock arm 12 to be elastically deformed such that the operating portion 16 approaches the second wall portion lib. The operating portion 16 in the embodiment has a rectangular shape. The operating portion 16 is located at a position more toward the insertion direction than the guard portion 11*f* is. The second arm portion 15 and the operating portion 16 guard the detection member 3 in a locked position, as will be described later.

A lock tab 17 is provided on a side surface 15*e* of the second arm portion 15. The lock tab 17 is disposed on an end portion in the removal direction of the second arm portion 15. To state the foregoing differently, the lock tabs 17 are disposed on end portions in the removal direction of the arm main unit 18. The lock tab 17 protrudes to a side opposite to the side of the first arm portion 13. Specifically, the lock tab 17 on one side protrudes in a direction away from the lock tab 17 on the other side. The lock tab 17 in the embodiment has a rectangular shape as viewed in the height direction H.

The first connector 10 in the embodiment also includes the lock arm 12 disposed on the second wall portion 11*b*.

As illustrated in FIG. 4, for example, the inner housing 2 in the embodiment is integrated with the shell 4. The inner housing 2 is integrated with the shell 4 by, for example, insert molding. The shell 4 is formed of, for example, metal having electric conductivity into a tubular shape. The shell 4 in the embodiment has a substantially elliptic cross-sectional shape. The inner housing 2 includes a fitting portion 21 and a terminal holding portion 22. The fitting portion 21 protrudes outwardly in a radial direction from the shell 4. The fitting portion 21 fits into the housing main unit 11 of the outer housing 1. In a front view, the fitting portion 21 has a substantially rectangular shape. The inner housing 2 includes a claw portion 23. The claw portion 23 engages with the housing main unit 11.

The terminal holding portion 22 holds the female terminal 5 and is disposed interior to the shell 4. The terminal holding portion 22 has a distal end protruding from the shell 4 along the axial direction X. In the embodiment, the inner housing 2 includes two terminal holding portions 22. The two terminal holding portions 22 are disposed in juxtaposition with each other along the width direction W.

The detection member 3 detects whether the first connector 10 and the second connector 20 completely engage with each other. The detection member 3 is formed of, for example, an insulating synthetic resin. As illustrated in in FIGS. 4 and 8, the detection member 3 includes a main unit 31, a restriction portion 32, and an arm portion 33. The main unit 31 is a plate-shaped or bar-shaped element. The restriction portion 32 protrudes from a center of the main unit 31 in a direction orthogonal to the main unit 31. The restriction portion 32 is provided with a tab portion 32*a* disposed at a distal end thereof. The tab portion 32*a* is formed into a plate shape. The restriction portion 32 is guided along the axial direction X by the pair of first arm portions 13A and 13B of the lock arm 12.

The arm portion 33 protrudes from an end portion of the main unit 31 in a direction orthogonal to the main unit 31. The arm portion 33 is formed to be flexible. The detection member 3 in the embodiment includes the two arm portions 33. The two arm portions 33 face each other across the restriction portion 32 interposed therebetween. The two arm portions 33 each include a protrusion to be locked 34. The protrusion to be locked 34 is disposed at a distal end of the arm portion 33. The protrusion to be locked 34 protrudes in a direction orthogonal to a direction in which the arm portion 33 extends. Each arm portion 33 is provided with one protrusion to be locked 34.

The detection member 3 is inserted, for example, in the removal direction with respect to the outer housing 1. As illustrated in FIG. 4, the detection member 3 is inserted in the outer housing 1 so that the restriction portion 32 and the arm portions 33 extend along the axial direction X and the restriction portion 32 and the arm portions 33 have distal ends thereof facing the removal direction. Meanwhile, the shell 4 and the inner housing 2 are inserted in the insertion direction with respect to the outer housing 1. The shell 4 and the inner housing 2 are inserted in the outer housing 1 in a posture in which the terminal holding portions 22 face toward the removal direction. The inner housing 2 is engaged with, and fixed to, the housing main unit 11. The shell 4 and the inner housing 2 support the detection member 3 inside the outer housing 1. More specifically, the shell 4 and the inner housing 2 support the detection member 3 such that the detection member 3 is slidable along the axial direction X with respect to the outer housing 1.

FIGS. 9 and 10 each illustrate a condition in which the detection member 3, the shell 4, and the inner housing 2 are mounted with respect to the outer housing 1. As illustrated in FIG. 10, the restriction portion 32 of the detection member 3 is inserted between the pair of first arm portions 13A and 13B. The restriction portion 32 is guided along the axial direction X by the two first arm portions 13A and 13B. The arm portions 33 of the detection member 3 are inserted in positions at which the arm portions 33 face the respective side surfaces 15*e* of the second arm portion 15. A slight gap exists between the arm portion 33 and the side surface 15*e*. Thus, the detection member 3 is movable along the axial direction X relative to the lock arm 12.

As illustrated in FIG. 9, the lock tab 17 of the lock arm 12 locks the protrusion to be locked 34 of the arm portion 33. Under a condition in which the detection member 3 is supported by the shell 4 and the inner housing 2, the lock tab 17 faces the protrusion to be locked 34 in the axial direction X. The detection member 3, when inserted in the outer housing 1, is locked by the lock tabs 17. In this specification, the position at which the protrusions to be locked 34 are locked by the lock tabs 17 is referred to as a "temporary locked position" of the detection member 3. The lock tabs 17 restricts motion of the detection member 3 in the removal direction beyond the temporary locked position.

The second connector 20 in the embodiment is a male connector including male terminals. As illustrated in FIGS. 11 and 12, the second connector 20 includes the housing 6, a shell 7, and male terminals 8. The electric wires 50 are connected with the respective male terminals 8. The housing 6 in the embodiment is integrated with the shell 7. The housing 6 is integrated with the shell 7 by, for example, insert molding. The shell 7 is formed of, for example, metal having electric conductivity. The shell 7 includes a tubular portion 71 and a flange portion 72. The tubular portion 71 has a substantially elliptic cross-sectional shape. The second connector 20 engages with the first connector 10 to cause the tubular portion 71 to be electrically connected with the shell 4 of the first connector 10.

The flange portion 72 protrudes from an end portion in the removal direction of the tubular portion 71 outwardly in a radial direction. The flange portion 72 has hole portions 72*a*, through which screws or other fastening members are passed. The flange portion 72 is fixed to, for example, a housing of an apparatus and grounded.

The housing 6 in the embodiment is integrated with the tubular portion 71. The housing 6 is formed of, for example, an insulating synthetic resin. The housing 6 includes a tubular portion 61 and a fitting portion 62. The tubular portion 61 has an outline of a cross-sectional shape substantially identical to an outline of a cross-sectional shape of the tubular portion 71 of the shell 7. The tubular portion 61 is joined with an end portion in the insertion direction of the tubular portion 71.

The fitting portion 62 is a part that engages with the outer housing 1 of the first connector 10. The fitting portion 62 is formed on the outside of the tubular portion 71 of the shell 7. The fitting portion 62 has a substantially rectangular cross-sectional shape. The fitting portion 62 includes a first wall portion 62*a*, a second wall portion 62*b*, a third wall portion 62*c*, and a fourth wall portion 62*d*. The first wall portion 62*a* and the second wall portion 62*b* face each other in the height direction H. The third wall portion 62*c* and the fourth wall portion 62*d* face each other in the width direction W. The first wall portion 62*a* includes a pair of ribs 63, a first protrusion 64, and a pair of second protrusions 65. The first protrusion 64 and the second protrusions 65 each have a cross-sectional shape of a trapezoidal protrusion on a cross section orthogonal to the width direction W.

The first protrusion 64 is formed at a center in the width direction W of the first wall portion 62*a*. The first protrusion 64 has an inclined face 64*a* and a top face 64*b*. The inclined face 64*a* is an end face of the first protrusion 64 facing anteriorly in the insertion direction. The inclined face 64*a* is inclined so as to extend toward the removal direction at distances closer to a distal end in a protruding direction along the height direction H. To state the foregoing differently, the inclined face 64*a* is inclined so as to face the first wall portion 11*a* of the housing main unit 11 when the housing 6 is inserted in the outer housing 1 of the first connector 10. The top face 64*b* is a distal end face of the first protrusion 64. The top face 64*b* faces in the height direction H. The top face 64*b* is, for example, a plane orthogonal to the height direction H.

The first protrusion 64 and the second protrusions 65 are disposed in juxtaposition with each other along the width direction W. The two second protrusions 65 are disposed across the first protrusion 64 interposed therebetween. Each second protrusion 65 have an inclined face 65*a* and a top face 65*b*. The inclined face 65*a* is inclined in a direction similar to a direction in which the inclined face 64*a* is inclined. The top face 65*b* is a distal end face of the second protrusion 65. The top face 65*b* faces toward the height direction H. The top face 65*b* is, for example, a plane orthogonal to the height direction H.

The ribs 63 are formed on both ends in the width direction W of the first wall portion 62*a*. The ribs 63 each extend from a first end to a second end of the first wall portion 62*a* along the axial direction X. As illustrated in FIG. 12, the ribs 63 have a protruding height Ht3 greater than a protruding height Ht1 of the first protrusion 64 and a protruding height Ht2 of the second protrusions 65. The protruding heights Ht1, Ht2, and Ht3 are each a height from an outer side surface 62*e* of the first wall portion 62*a*.

The second wall portion 62*b* of the second connector 20 in the embodiment also includes a pair of ribs 63, a first protrusion 64, and a pair of second protrusions 65.

The housing 6 of the second connector 20 is inserted in the housing main unit 11 of the first connector 10 as indicated by an arrow Y1 illustrated in FIG. 13. The housing 6 is inserted in the outer housing 1, having the tubular portion 61 at the front toward the insertion direction. FIG. 13 illustrates a condition in which the second protrusions 65 of the fitting portion 62 contact the lock tabs 17 of the lock arms 12. The second protrusion 65 is formed such that, upon insertion of the housing 6 with respect to the housing main unit 11, the inclined face 65*a* contacts the lock tab 17. The lock tab 17 is pressed by the inclined face 65*a* up against the first wall portion 11*a* as indicated by an arrow Y2. A gap that permits elastic deformation of the lock arm 12 is provided between an upper surface 12*a* of the lock arm 12 and the first wall portion 11*a*. The pressure received from the second protrusions 65 causes the lock arm 12 to be flexurally deformed so as to approach the first wall portion 11*a*. The foregoing action causes the lock tabs 17 to ride over the second protrusions 65. As a result, the second protrusion 65 is locked by the lock tab 17 as illustrated in FIG. 14. Similarly, the beam portion 14 of the lock arm 12 is pressed by the first protrusion 64 toward the first wall portion 11*a* and thus rides over the first protrusion 64. The beam portion 14 is locked by the first protrusion 64.

The position at which the second protrusions 65 are locked by the lock tabs 17 represents a complete fitting position of the first connector 10 and the second connector 20. At the complete fitting position, the male terminals 8 of the second connector 20 are inserted in the female terminals 5 of the first connector 10 and an electric connection is established between the male terminals 8 and the female terminals 5. In this specification, a state in which the second connector 20 is inserted in the first connector 10 all the way up to the complete fitting position is referred to as a complete fitting state.

As illustrated in FIG. 14, in the complete fitting state, the detection member 3 is movable toward the removal direction. More specifically, the protrusion to be locked 34 of the detection member 3 is supported by the top face 65*b* of the second protrusion 65. The second protrusion 65 presses the arm portion 33 toward the first wall portion 11*a* to bend the arm portion 33 toward the first wall portion 11*a*. The top face 65*b* of the second protrusion 65 guides a distal end portion 33*a* of the arm portion 33 onto a gap G1 between the lock tab 17 and the first wall portion 11*a*. In the complete fitting state, the top face 65*b* of the second protrusion 65 is located on a plane substantially identical to an outer side surface 17*a* of the lock tab 17. Thus, the protrusion to be locked 34 can move toward the removal direction while being supported on the top face 65*b* and the outer side surface 17*a*.

An operator who fits the first connector 10 in the second connector 20 inserts the detection member 3 toward the removal direction. As a result, the protrusion to be locked 34 of the arm portion 33 rides over the lock tab 17 as indicated by an arrow Y3 illustrated in FIG. 14. The foregoing step results in the protrusion to be locked 34 moving to a position in the removal direction beyond the lock tab 17 as illustrated in FIG. 15. The arm portion 33 turns to a shape as illustrated in FIG. 15 through elastic resilience. In the arm portion 33 illustrated in FIG. 15, the lock tab 17 faces the protrusion to be locked 34 in the axial direction X. Thus, the protrusion to be locked 34 is locked by the lock tab 17. Specifically, motion of the arm portion 33 in the insertion direction is restricted.

The arm portion 33 is located in the gap G1 between the lock tab 17 and the first wall portion 11*a* to restrict the lift of the lock tab 17. The lift of the lock tab 17 is restricted, and thereby a state of locking the second protrusion 65 is maintained, so that the complete fitting state of the first connector 10 and the second connector 20 is maintained. In the description that follows, the state of the detection member 3, in which the protrusion to be locked 34 is located at a position in the removal direction beyond the lock tab 17, is referred to as a "locking state".

As will be described with reference to FIGS. 16 and 17, the tab portion 32*a* of the restriction portion 32 restricts the lift of the lock arm 12. FIG. 16 illustrates the detection member 3 at the temporary locked position. More specifically, FIG. 16 illustrates a condition in which the first connector 10 completely engages with the second connector 20 and the detection member 3 is not yet pushed into the locking state. The first protrusion 64 of the second connector 20 is locked by the beam portion 14. Thus, motion of the second connector 20 in the removal direction relative to the first connector 10 is restricted.

When the detection member 3 is located at the temporary locked position as illustrated in FIG. 16, the tab portion 32*a* of the restriction portion 32 is located at a position farther in the insertion direction relative to the beam portion 14. Thus, a gap G2, which permits elastic deformation of the lock arm 12, exists between the beam portion 14 and the first wall portion 11*a*. To state the foregoing differently, the detection member 3 at the temporary locked position permits elastic deformation of the lock arm 12. When the operator pushes the detection member 3 at the temporary locked position toward the removal direction, the tab portion 32*a* moves into the gap G2 as illustrated in FIG. 17. At this time, the first protrusion 64 may guide the tab portion 32*a* into the gap G2 between the beam portion 14 and the first wall portion 11*a*.

The tab portion 32*a* inserted into the gap G2 restricts the lift of the beam portion 14. Specifically, the tab portion 32*a* restricts elastic deformation of the lock arm 12 toward the first wall portion 11*a*. Because the lift of the lock arm 12 is restricted by the tab portion 32*a*, a state in which the beam portion 14 locks the first protrusion 64 is maintained. Specifically, the tab portion 32*a* maintains the state in which the lock arm 12 locks the second connector 20 and restricts unintentional breaking off of the second connector 20. As such, the detection member 3 in the embodiment has a function of detecting that the first connector 10 completely engages with the second connector 20 and a lock function that maintains the complete fitting state of the first connector 10 and the second connector 20.

In the embodiment, the detection member 3 can not be inserted into the position of the locking state until when the complete fitting state of the first connector 10 and the second connector 20 is reached. FIG. 18 illustrates a half-fitting state of the first connector 10 and the second connector 20. In the state illustrated in FIG. 18, the lock tab 17 rides the second protrusion 65. Under the foregoing condition, the lock tab 17 abuts against the protrusion to be locked 34 to restrict motion of the arm portion 33. Thus, the lock tab 17 restricts motion of the detection member 3 even when the operator attempts to insert the detection member 3 toward the removal direction. Thus, the operator readily knows that the first connector 10 does not completely engage with the second connector 20.

When the detection member 3 is inserted in the position of the locking state, the detection member 3 is covered in the operating portion 16 as illustrated in FIG. 1. The detection member 3 enters a gap between the operating portion 16 and the shell 4, so that substantially a rear end face of the detection member 3 can only be visible from the outside. A user is thus prevented from carelessly touching and operating the detection member 3. Specifically, the locking state of the detection member 3 can only be canceled substantially by using, for example, a tool.

In the first connector 10 in the embodiment, the lock arm 12 protrudes from the first wall portion 11*a* of the housing main unit 11 to the space portion 19, which is surrounded by the housing main unit 11. The arm main unit 18 of the lock arm 12 is subject to elastic deformation, such as flexural deformation, in the space portion 19 as a movable space. The first connector 10 in the embodiment uses a space, the space being provided to allow for dimensional tolerances of members, as a movable space for the lock arm 12. The first connector 10 in the embodiment thus can achieve reduction in size of the housing main unit 11.

For example, in the embodiment, the space between an inner wall surface of the housing main unit 11 and the housing 6 of the second connector 20 serves as the movable space for the lock arm 12. An inside dimension in the height direction H in the housing main unit 11 is established, for example, such that the ribs 63 of the housing 6 do not interfere with the housing main unit 11. A gap between the first wall portion 62*a* of the housing 6 and the first wall portion 11*a* of the housing main unit 11 resulting from the foregoing arrangement is used as part of the movable space for the lock arm 12. As such, the first connector 10 and the connector structure 100 in accordance with the embodiment can reduce size of the housing main unit 11, while achieving a half-fitting detection mechanism through the use of the detection member 3 and the lock arm 12.

The lock arm 12 protrudes toward the space portion 19 to allow the protruding height Ht1 of the first protrusion 64 and the protruding height Ht2 of the second protrusion 65 to be reduced in the second connector 20. Thus, reduction in size can be achieved of the first connector 10 and the second connector 20.

The first connector 10 and the connector structure 100 in accordance with the embodiment can cover the detection member 3 with the first wall portion 11*a* to thereby protect the detection member 3 with the first wall portion 11*a*. Thus, the locking state of the detection member 3 can be prevented from being carelessly canceled.

The first wall portion 11*a* functions as a support wall for supporting the detection member 3. Consider, for example, a case in which an external force acts on the first connector 10 or the second connector 20 and a force may be applied to the detection member 3 in a direction toward the first wall portion 11*a*. At this time, the first wall portion 11*a* can support the detection member 3 to restrict the lift of the detection member 3. The first wall portion 11*a* thus prevents unintentional cancellation of the locking state and improves reliability of the connector structure 100.

In the second connector 20 in the embodiment, the protruding height Ht3 of the ribs 63 is greater than the protruding height Ht1 of the first protrusion 64 and the protruding height Ht2 of the second protrusion 65. Thus, the ribs 63 can appropriately protect the first protrusion 64 and the second protrusion 65. The ribs 63 protect the first protrusion 64 and the second protrusion 65 from contact with a tool or any other part during transportation of the second connector 20 or during assembly of the second connector 20 with respect to the first connector 10.

As described above, the first connector 10 in the embodiment includes the outer housing 1, the inner housing 2, and the detection member 3. The outer housing 1 includes the housing main unit 11 with a tubular shape and the lock arm 12. The lock arm 12 protrudes from the first wall portion 11*a* of the housing main unit 11 to the space portion 19, which is surrounded by the housing main unit 11. The inner housing 2 holds the female terminals 5 and is disposed interior to the housing main unit 11. In the embodiment, the female terminals 5 correspond to a first terminal. The detection member 3 is supported between the first wall portion 11*a* and the inner housing 2 slidably along the axial direction X of the housing main unit 11.

The housing main unit 11 has the opening portion 11*h*. The opening portion 11*h* is an opening into which the housing 6 of the second connector 20 is inserted, the housing 6 including the first protrusion 64 and the second protrusions 65 and holding the male terminals 8. In the embodiment, the male terminals 8 correspond to a second terminal. The housing 6 corresponds to a counterpart housing.

The lock arm 12 includes the arm main unit 18 with flexiblity which extends toward the opening portion 11*h*, and the lock tabs 17, which protrude from the arm main unit 18. When the housing 6 is inserted in the housing main unit 11 through the opening portion 11*h*, the arm main unit 18 of the lock arm 12 is elastically deformed, so that the lock tabs 17 ride over the second protrusions 65 to thereby lock the second protrusions 65.

When the lock tabs 17 have not yet ridden over the second protrusions 65 while the housing 6 is being inserted in the housing main unit 11, the lock tabs 17 lock the detection member 3 to thereby restrict motion of the detection member 3 toward the opening portion 11*h*. When the lock tabs 17 complete riding over the second protrusions 65, the lock tabs 17 allow the detection member 3 to move toward the opening portion 11*h*. The first connector 10 in the embodiment can achieve reduction in size of the first connector 10, while including the mechanism that detects half-fitting of the first connector 10 and the second connector 20.

In the first connector 10 in the embodiment, the arm main unit 18 includes the first arm portion 13, the second arm portion 15, and the operating portion 16. The first arm portion 13 protrudes from the first wall portion 11*a* and extends toward the opening portion 11*h*. The second arm portion 15 extends from the distal end of the first arm portion 13 toward the side opposite to the opening portion 11*h*. The operating portion 16 is disposed at the distal end of the second arm portion 15 and exposed to the outside of the housing main unit 11. The arm main unit 18 has a fold-back structure to allow the second protrusions 65 to be locked in the space portion 19 and the arm main unit 18 to be operated from the operating portion 16.

The arm main unit 18 in the embodiment includes the pair of first arm portions 13A and 13B. The first arm portions 13A and 13B are disposed in juxtaposition with each other in the width direction W of the first wall portion 11*a* across the restriction portion 32 of the detection member 3 interposed therebetween. The first arm portions 13A and 13B guide the restriction portion 32 along the axial direction X. The first arm portions 13A and 13B can stabilize the operation of the detection member 3.

The connector structure 100 in the embodiment includes the first connector 10 and the second connector 20 configured to engage with the first connector 10. The first connector 10 includes the outer housing 1, the inner housing 2, and the detection member 3. The second connector 20 includes the housing 6, the housing 6 including the first protrusion 64 and the second protrusions 65 and holding the male terminals 8. The connector structure 100 in the embodiment can achieve reduction in size of the first connector 10 and the second connector 20, while including the mechanism that detects half-fitting of the first connector 10 and the second connector 20.

When the lock tabs 17 complete riding over the second protrusions 65, the second protrusions 65 in the embodiment guide the distal end portions 33*a* of the detection member 3 onto the gap G1 between the lock tab 17 and the first wall portion 11*a*. The second protrusions 65 can guide the distal end portions 33*a* of the detection member 3 to a desired position and operate the detection member 3 smoothly.

In the embodiment, the housing 6 of the second connector 20 includes the ribs 63, which are disposed across the first protrusion 64 and the second protrusions 65 interposed therebetween and extends in the axial direction X. The ribs 63 have the protruding height Ht3 equal to or greater than the protruding height Ht1 of the first protrusion 64 and the protruding height Ht2 of the second protrusions 65. Thus, the ribs 63 can appropriately protect the first protrusion 64 and the second protrusions 65. It is noted that, as illustrated in the embodiment, the protruding height Ht3 of the ribs 63 may be greater than the protruding height Ht1 of the first protrusion 64 or the protruding height Ht2 of the second protrusions 65.

The detection member 3 in the embodiment includes the tab portion 32*a*, which is to be inserted in the gap G2 between the lock arm 12 and the first wall portion 11*a*. The tab portion 32*a* is inserted in the gap G2 between the lock arm 12 and the first wall portion 11*a* when the detection member 3 which has been locked by the lock tabs 17 moves toward the opening portion 11*h*. The tab portion 32*a* thereby restricts elastic deformation of the lock arm 12 toward the first wall portion 11*a*. By restricting elastic deformation of the lock arm 12, the tab portion 32*a* can maintain the fitting state of the first connector 10 and the second connector 20.

The ribs 63 may serve as rotation prevention ribs that prevent the second connector 20 from rotating relative to the first connector 10. In this case, the protruding height Ht3 of the ribs 63 is determined to correspond to the shape of the housing main unit 11. In the embodiment, the lock arm 12 protrudes to the space portion 19 and extends in the space portion 19. This arrangement allows the protruding height Ht1 of the first protrusion 64 and the protruding height Ht2 of the second protrusions 65 to be small. The ribs 63 thus can enhance a function of protecting the first protrusion 64 and the second protrusions 65.

Modification of the Embodiment

The following describes modifications of the embodiment. The configurations and shapes of the first connector 10 and the second connector 20 described above are illustrative only and not limiting. For example, the shapes of the lock arm 12 and the detection member 3 are not limited to those illustrated above. The detection member 3 may be disposed not only between the first wall portion 11*a* and the outer housing 1 but also between the second wall portion 11*b* and the outer housing 1.

In the embodiment, the outer housing 1 is separate from the inner housing 2. The outer housing 1 may nonetheless be integrated with the inner housing 2.

The first connector 10 may be a male connector that holds the male terminals 8. In this case, the second connector 20 is configured as a female connector that holds the female terminals 5.

Details of the embodiment and the modifications disclosed above may be combined as appropriate.

The connector in the embodiment includes: the outer housing including the housing main unit with a tubular shape and the arm that protrudes from the first wall portion of the housing main unit to the space portion surrounded by the housing main unit; the inner housing disposed interior to the housing main unit, the inner housing holding the first terminal; and the detection member supported between the first wall portion and the inner housing slidably along the axial direction of the housing main unit.

The housing main unit has the opening portion in which the counterpart housing is inserted, the counterpart housing including a protrusion and holding the second terminal. The arm includes the flexible arm main unit that extends toward the opening portion and the lock tab that protrudes from the arm main unit. When the counterpart housing is inserted in the housing main unit through the opening portion, the arm main unit of the arm is elastically deformed to thereby enable the lock tab to ride over and lock the protrusion. When the lock tab has not yet ridden over the protrusion while the counterpart housing is being inserted in the housing main unit, the lock tab locks the detection member to thereby restrict motion of the detection member toward the opening portion, and when the lock tab completes riding over the protrusion, the lock tab allows the detection member to move toward the opening portion. The connector in the embodiment uses a space between the housing main unit and the counterpart housing as an arm movable space. Thus, a space provided to allow for dimensional tolerances of members can be used as at least part of a movable space for the arm. The connector in the embodiment thus can achieve reduction in size of the connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

an outer housing including a housing main unit with a tubular shape and an arm that protrudes from a first wall portion of the housing main unit to a space portion surrounded by the housing main unit;

an inner housing disposed interior to the housing main unit; the inner housing holding a first terminal; and a detection member supported between the first wall portion and the inner housing slidably along an axial direction of the housing main unit, wherein the housing main unit has an opening portion in which a counterpart housing is inserted, the counterpart housing including a protrusion and holding a second terminal, the arm includes an arm main unit with flexibility that extends toward the opening portion and a lock tab that protrudes from the arm main unit, when the counterpart housing is inserted in the housing main unit through the opening portion, the arm main unit of the arm is elastically deformed to enable the lock tab to ride over and lock the protrusion, and when the counterpart housing is inserted into the housing main unit, the lock tab locks the detection member to restrict motion of the detection member toward the opening portion while the lock tab has not yet ridden over the protrusion; and the lock tab allows the detection member to move toward the opening portion after the lock tab completes tiding over the protrusion.

2. The connector according to claim 1, wherein the arm main unit includes a first arm portion that protrudes from the first wall portion and extends toward the opening portion, a second arm portion that extends from a distal end of the first arm portion toward a side opposite to the opening portion, and an operating portion disposed at a distal end of the second arm portion and exposed to the outside of the housing main unit.

3. A connector structure comprising:

a first connector having a first terminal; and a second connector configured to engage with the first connector and having a second terminal to be connected with the first terminal, wherein the first connector includes:

an outer housing including a housing main unit with a tubular shape and an arm that protrudes from a first wall portion of the housing main unit to a space portion surrounded by the housing main unit;

an inner housing disposed interior to the housing main unit, the inner housing holding the first terminal; and a detection member supported between the first wall portion and the inner housing slidably along an axial direction of the housing main unit, the second connector includes a housing that includes a protrusion and holds the second terminal, the housing main unit has an opening portion in which the housing of the second connector is inserted, the arm includes an arm main unit with flexibility that extends toward the opening portion and a lock tab that protrudes from the arm main unit, when the housing of the second connector is inserted into the housing main unit through the opening portion, the arm main unit of the arm is elastically deformed to enable the lock tab to ride over and lock the protrusion, and when the housing of the second connector is inserted into the housing main unit, the lock tab locks the detection member to restrict motion of the detection member toward the opening portion while the lock tab has not yet ridden over the protrusion, and the lock tab allows the detection member to move toward the opening portion after the lock tab completes riding over the protrusion.

4. The connector structure according to claim 3, wherein when the lock tab completes riding over the protrusion, the protrusion guides a distal end portion of the detection member onto a gap between the lock tab and the first wall portion.

5. The connector structure according to claim 4, wherein the housing of the second connector includes a pair of ribs extending in the axial direction and disposed such that the protrusion is interposed therebetween, and the pair of ribs has a protruding height equal to or greater than a protruding height of the protrusion.

6. The connector structure according to claim 5, wherein the detection member includes a tab portion to be inserted in a gap between the arm and the first wall portion, and the tab portion is inserted in the gap between the arm and the first wall portion by the movement of the detection member that has been locked by the lock tab toward the opening portion, thereby restricting elastic deformation of the arm toward the first wall portion.

7. The connector structure according to claim 4, wherein the detection member includes a tab portion to be inserted in a gap between the arm and the first wall portion, and the tab portion is inserted in the gap between the arm and the first wall portion by the movement of the detection member that has been locked by the lock tab toward the opening portion, thereby restricting elastic deformation of the arm toward the first wall portion.

8. The connector structure according to claim 3, wherein the housing of the second connector includes a pair of ribs extending in the axial direction and disposed such that the protrusion is interposed therebetween, and the pair of ribs has a protruding height equal to or greater than a protruding height of the protrusion.

9. The connector structure according to claim 8, wherein the detection member includes a tab portion to be inserted in a gap between the arm and the first wall portion, and the tab portion is inserted in the gap between the arm and the first wall portion by the movement of the detection member that has been locked by the lock tab toward the opening portion, thereby restricting elastic deformation of the arm toward the first wall portion.

10. The connector structure according to claim 3, wherein the detection member includes a tab portion to be inserted in a gap between the arm and the first wall portion, and the tab portion is inserted in the gap between the arm and the first wall portion by the movement of the detection member that has been locked by the lock tab toward the opening portion, thereby restricting elastic deformation of the arm toward the first wall portion.

* * * * *